US007862476B2

(12) United States Patent
Blau et al.

(10) Patent No.: US 7,862,476 B2
(45) Date of Patent: Jan. 4, 2011

(54) EXERCISE DEVICE

(75) Inventors: David A. Blau, Cupertino, CA (US); Scott B. Radow, 1340 Lincoln Rd. #403, Miami Beach, FL (US) 33139

(73) Assignee: Scott B. Radow, Miami Beach, FL (US)

( * ) Notice: Subject to any disclaimer, the term of this patent is extended or adjusted under 35 U.S.C. 154(b) by 0 days.

(21) Appl. No.: 11/644,777

(22) Filed: Dec. 22, 2006

(65) Prior Publication Data

US 2007/0149364 A1 Jun. 28, 2007

Related U.S. Application Data

(60) Provisional application No. 60/753,031, filed on Dec. 22, 2005.

(51) Int. Cl.
*A63B 71/00* (2006.01)

(52) U.S. Cl. ..... 482/8; 482/5; 482/57

(58) Field of Classification Search ..... 482/1–8, 482/52, 57, 63, 110, 900–902, 9, 51; 73/379.06; 434/61, 247, 255

See application file for complete search history.

(56) References Cited

U.S. PATENT DOCUMENTS 3,375,717 A * 4/1968 Impellizzeri et al. ..... 73/379.07
3,589,193 A * 6/1971 Thornton ..... 482/2
3,859,840 A * 1/1975 Gause ..... 73/1.08
3,903,613 A * 9/1975 Bisberg ..... 434/61
3,964,742 A * 6/1976 Carnielli ..... 482/7
4,060,239 A * 11/1977 Pfleiderer et al. ..... 482/2
4,084,810 A * 4/1978 Forsman ..... 482/5
4,235,437 A 11/1980 Ruis et al.

(Continued)

FOREIGN PATENT DOCUMENTS

DE 32 18 086 A1 12/1983

(Continued)

OTHER PUBLICATIONS

Performance Measures for Haptic Interfaces, Vincent Hayward and Oliver R. Astley, 1996, pp. 1-20.

(Continued)

*Primary Examiner*—Loan Thanh
*Assistant Examiner*—Daniel F Roland
(74) *Attorney, Agent, or Firm*—Price, Heneveld, Cooper, DeWitt & Litton, LLP

(57) ABSTRACT

A control system and method for exercise equipment and the like provides a way to simulate a physical activity in a manner that takes into account the physics of the physical activity being simulated to provide an accurate simulation. According to one aspect of the present invention, the control system and method takes into account the physics of the corresponding physical activity to generate a virtual or predicted value of a variable such as velocity, acceleration, force, or the like. The difference between the virtual or expected physical variable and a measured variable is used as a control input to control resistance forces of the exercise equipment in a way that causes the user to experience forces that are the same or similar to the forces that would be encountered if the user were actually performing the physical activity being simulated rather than using the exercise equipment.

28 Claims, 27 Drawing Sheets

U.S. PATENT DOCUMENTS

| | | | | | |
|---|---|---|---|---|---|
| 4,358,105 | A | * | 11/1982 | Sweeney, Jr. | 482/5 |
| 4,542,897 | A | * | 9/1985 | Melton et al. | 463/7 |
| 4,600,016 | A | | 7/1986 | Boyd et al. | |
| 4,613,129 | A | * | 9/1986 | Schroeder et al. | 482/63 |
| 4,642,070 | A | * | 2/1987 | Walker | 474/57 |
| 4,678,182 | A | * | 7/1987 | Nakao et al. | 482/9 |
| 4,687,195 | A | | 8/1987 | Potts | |
| 4,687,196 | A | | 8/1987 | Dubrinsky et al. | |
| 4,709,917 | A | | 12/1987 | Yang | |
| 4,775,145 | A | * | 10/1988 | Tsuyama | 482/63 |
| 4,817,938 | A | * | 4/1989 | Nakao et al. | 482/4 |
| 4,822,036 | A | * | 4/1989 | Dang | 482/6 |
| 4,822,037 | A | * | 4/1989 | Makansi et al. | 482/6 |
| 4,824,104 | A | | 4/1989 | Bloch | |
| 4,869,497 | A | * | 9/1989 | Stewart et al. | 482/5 |
| 4,880,230 | A | | 11/1989 | Cook | |
| 4,890,495 | A | | 1/1990 | Slane | |
| 4,891,764 | A | * | 1/1990 | McIntosh | 700/183 |
| 4,934,692 | A | * | 6/1990 | Owens | 482/63 |
| 4,934,694 | A | * | 6/1990 | McIntosh | 482/9 |
| 4,938,474 | A | * | 7/1990 | Sweeney et al. | 482/52 |
| 4,938,475 | A | * | 7/1990 | Sargeant et al. | 482/9 |
| 4,941,652 | A | * | 7/1990 | Nagano et al. | 482/73 |
| 4,958,831 | A | * | 9/1990 | Kim | 482/65 |
| 4,976,424 | A | | 12/1990 | Sargeant et al. | |
| 4,998,725 | A | * | 3/1991 | Watterson et al. | 482/6 |
| 5,018,726 | A | | 5/1991 | Yorioka | |
| 5,027,303 | A | * | 6/1991 | Witte | 702/44 |
| 5,067,710 | A | * | 11/1991 | Watterson et al. | 482/3 |
| 5,070,816 | A | | 12/1991 | Wehrell | |
| 5,083,772 | A | * | 1/1992 | Brown | 482/59 |
| 5,154,677 | A | | 10/1992 | Ito | |
| 5,163,886 | A | * | 11/1992 | Seol | 482/57 |
| 5,181,904 | A | | 1/1993 | Cook et al. | |
| 5,230,673 | A | * | 7/1993 | Maeyama et al. | 482/5 |
| 5,234,392 | A | | 8/1993 | Clark | |
| 5,240,417 | A | * | 8/1993 | Smithson et al. | 434/61 |
| 5,242,339 | A | | 9/1993 | Thornton | |
| 5,256,115 | A | | 10/1993 | Scholder et al. | |
| 5,259,611 | A | * | 11/1993 | Dalebout et al. | 482/5 |
| 5,267,925 | A | * | 12/1993 | Boyd | 482/64 |
| 5,312,311 | A | * | 5/1994 | Pearson | 482/57 |
| 5,318,487 | A | * | 6/1994 | Golen et al. | 482/5 |
| 5,324,242 | A | * | 6/1994 | Lo | 482/63 |
| 5,382,207 | A | | 1/1995 | Skowronski et al. | |
| 5,466,203 | A | * | 11/1995 | Chen | 482/63 |
| 5,470,293 | A | | 11/1995 | Schönenberger | |
| 5,492,513 | A | * | 2/1996 | Wang | 482/4 |
| 5,545,112 | A | * | 8/1996 | Densmore et al. | 482/54 |
| 5,562,572 | A | | 10/1996 | Carmein | |
| 5,577,598 | A | | 11/1996 | Schonenberger | |
| 5,580,249 | A | | 12/1996 | Jacobsen et al. | |
| 5,583,403 | A | | 12/1996 | Anjanappa et al. | |
| 5,587,937 | A | | 12/1996 | Massie et al. | |
| 5,625,576 | A | | 4/1997 | Massie et al. | |
| 5,690,591 | A | | 11/1997 | Kenmochi et al. | |
| 5,704,253 | A | | 1/1998 | Book et al. | |
| 5,738,612 | A | * | 4/1998 | Tsuda | 482/8 |
| 5,779,596 | A | * | 7/1998 | Weber | 482/4 |
| 5,872,438 | A | | 2/1999 | Roston | |
| 5,888,172 | A | * | 3/1999 | Andrus et al. | 482/7 |
| 5,898,599 | A | | 4/1999 | Massie et al. | |
| 5,919,115 | A | * | 7/1999 | Horowitz et al. | 482/6 |
| 5,947,869 | A | * | 9/1999 | Shea | 482/8 |
| 5,952,796 | A | | 9/1999 | Colgate et al. | |
| 5,980,256 | A | | 11/1999 | Carmein | |
| 5,984,880 | A | | 11/1999 | Lander et al. | |
| 6,028,593 | A | | 2/2000 | Rosenberg et al. | |
| 6,050,822 | A | | 4/2000 | Faughn | |
| 6,050,920 | A | | 4/2000 | Ehrenfried | |
| 6,056,670 | A | * | 5/2000 | Shu et al. | 482/4 |
| 6,059,696 | A | | 5/2000 | Bohmer et al. | |
| 6,066,075 | A | | 5/2000 | Poulton | |
| 6,126,571 | A | | 10/2000 | Parks | |
| 6,126,575 | A | | 10/2000 | Wang | |
| 6,142,913 | A | | 11/2000 | Ewert | |
| 6,147,674 | A | | 11/2000 | Rosenberg et al. | |
| 6,152,854 | A | | 11/2000 | Carmein | |
| 6,162,151 | A | | 12/2000 | Tani et al. | |
| 6,162,189 | A | | 12/2000 | Girone et al. | |
| 6,171,218 | B1 | * | 1/2001 | Shea | 482/57 |
| 6,231,527 | B1 | | 5/2001 | Sol | |
| 6,251,048 | B1 | * | 6/2001 | Kaufman | 482/8 |
| 6,267,709 | B1 | * | 7/2001 | Jacques et al. | 482/8 |
| 6,356,848 | B1 | | 3/2002 | Cote et al. | |
| 6,366,272 | B1 | | 4/2002 | Rosenberg et al. | |
| 6,405,158 | B1 | | 6/2002 | Massie et al. | |
| 6,418,797 | B1 | | 7/2002 | Ambrosina et al. | |
| 6,436,008 | B1 | | 8/2002 | Skowronski et al. | |
| 6,450,922 | B1 | | 9/2002 | Henderson et al. | |
| 6,454,679 | B1 | | 9/2002 | Radow | |
| 6,464,618 | B1 | * | 10/2002 | Shea | 482/8 |
| 6,475,115 | B1 | * | 11/2002 | Candito et al. | 482/4 |
| 6,482,128 | B1 | | 11/2002 | Michalow | |
| 6,527,681 | B2 | | 3/2003 | Tacx | |
| 6,554,252 | B2 | | 4/2003 | Kazerooni et al. | |
| 6,593,710 | B2 | * | 7/2003 | Reck | 318/1 |
| 6,605,021 | B2 | * | 8/2003 | Kobayashi et al. | 482/57 |
| 6,607,471 | B2 | * | 8/2003 | Reck | 482/57 |
| 6,634,992 | B1 | * | 10/2003 | Ogawa | 482/8 |
| 6,652,425 | B1 | * | 11/2003 | Martin et al. | 482/57 |
| 6,659,917 | B1 | | 12/2003 | Tacx | |
| 6,676,569 | B1 | | 1/2004 | Radow | |
| 6,730,003 | B1 | | 5/2004 | Phillips | |
| 6,736,762 | B2 | * | 5/2004 | Chen | 482/63 |
| 6,749,537 | B1 | | 6/2004 | Hickman | |
| 6,786,848 | B2 | * | 9/2004 | Yamashita et al. | 482/8 |
| 6,827,579 | B2 | | 12/2004 | Burdea et al. | |
| 6,852,068 | B2 | * | 2/2005 | Ogawa | 482/8 |
| 6,853,965 | B2 | | 2/2005 | Massie et al. | |
| 6,918,860 | B1 | * | 7/2005 | Nusbaum | 482/57 |
| 6,921,351 | B1 | | 7/2005 | Hickman et al. | |
| 6,930,590 | B2 | | 8/2005 | Ling et al. | |
| 7,004,888 | B1 | * | 2/2006 | Weng | 482/57 |
| 7,027,055 | B2 | | 4/2006 | Anderson et al. | |
| 7,033,176 | B2 | | 4/2006 | Feldman et al. | |
| 7,039,866 | B1 | | 5/2006 | Rosenberg et al. | |
| 7,044,891 | B1 | * | 5/2006 | Rivera | 482/8 |
| 7,047,817 | B2 | | 5/2006 | Lanham | |
| 7,050,050 | B2 | | 5/2006 | Tackett | |
| 7,066,865 | B2 | | 6/2006 | Radow | |
| 7,090,620 | B1 | * | 8/2006 | Barlow | 482/63 |
| 7,094,184 | B1 | * | 8/2006 | Chen et al. | 482/93 |
| 7,097,596 | B2 | * | 8/2006 | Yang | 482/57 |
| 7,113,166 | B1 | | 9/2006 | Rosenberg et al. | |
| 7,158,112 | B2 | | 1/2007 | Rosenberg et al. | |
| 7,163,490 | B2 | * | 1/2007 | Chen | 482/8 |
| 7,205,981 | B2 | * | 4/2007 | Cunningham | 345/163 |
| 7,220,219 | B2 | | 5/2007 | Papadopoulos et al. | |
| 7,257,468 | B1 | * | 8/2007 | Costa et al. | 701/1 |
| 7,311,640 | B2 | | 12/2007 | Baatz | |
| 2001/0011052 | A1 | * | 8/2001 | Shu et al. | 482/2 |
| 2001/0019985 | A1 | * | 9/2001 | Reck | 482/5 |
| 2001/0036883 | A1 | * | 11/2001 | Suzuki | 482/8 |
| 2002/0013197 | A1 | | 1/2002 | Tacx | |
| 2002/0016236 | A1 | * | 2/2002 | Stearns et al. | 482/57 |
| 2002/0077221 | A1 | * | 6/2002 | Dalebout et al. | 482/57 |
| 2002/0147079 | A1 | * | 10/2002 | Kalnbach | 482/57 |
| 2003/0013995 | A1 | * | 1/2003 | Oshima et al. | 600/587 |
| 2003/0073546 | A1 | | 4/2003 | Lassanske et al. | |
| 2004/0034282 | A1 | | 2/2004 | Quaid, III | |
| 2004/0034283 | A1 | | 2/2004 | Quaid, III | |
| 2004/0034302 | A1 | | 2/2004 | Abovitz et al. | |
| 2004/0034795 | A1 | | 2/2004 | Anderson et al. | |

| | | | | |
|---|---|---|---|---|
| 2004/0036721 | A1 | 2/2004 | Anderson et al. | |
| 2004/0040805 | A1 | 3/2004 | Bailey | |
| 2004/0106502 | A1* | 6/2004 | Sher | 482/8 |
| 2004/0106916 | A1 | 6/2004 | Quaid et al. | |
| 2004/0239486 | A1* | 12/2004 | Li et al. | 340/286.01 |
| 2005/0014610 | A1* | 1/2005 | Wu | 482/63 |
| 2005/0024331 | A1 | 2/2005 | Berkley et al. | |
| 2005/0107221 | A1* | 5/2005 | Vohryzka | 482/57 |
| 2005/0142525 | A1 | 6/2005 | Cotin et al. | |
| 2005/0148432 | A1 | 7/2005 | Carmein | |
| 2005/0219228 | A1 | 10/2005 | Alameh et al. | |
| 2005/0222830 | A1 | 10/2005 | Massie et al. | |
| 2005/0227823 | A1* | 10/2005 | Liao | 482/57 |
| 2005/0233285 | A1* | 10/2005 | Miyamaru et al. | 434/61 |
| 2005/0264527 | A1 | 12/2005 | Lin | |
| 2006/0003872 | A1* | 1/2006 | Chiles et al. | 482/57 |
| 2006/0030383 | A1 | 2/2006 | Rosenberg et al. | |
| 2006/0064223 | A1* | 3/2006 | Voss | 701/52 |
| 2006/0094569 | A1* | 5/2006 | Day | 482/57 |
| 2006/0106326 | A1 | 5/2006 | Krebs et al. | |
| 2006/0166790 | A1* | 7/2006 | Wang | 482/8 |
| 2006/0179837 | A1 | 8/2006 | Buerger et al. | |
| 2006/0180225 | A1 | 8/2006 | Buerger et al. | |
| 2006/0190093 | A1 | 8/2006 | Buerger et al. | |
| 2006/0234840 | A1 | 10/2006 | Watson et al. | |
| 2006/0281606 | A1 | 12/2006 | Radow | |
| 2006/0293617 | A1 | 12/2006 | Einav et al. | |
| 2007/0010772 | A1 | 1/2007 | Ryan | |
| 2007/0013655 | A1 | 1/2007 | Rosenberg et al. | |
| 2007/0023244 | A1 | 2/2007 | Carlson et al. | |
| 2007/0066918 | A1 | 3/2007 | Dewald et al. | |
| 2007/0082788 | A1* | 4/2007 | Ciervo | 482/8 |
| 2007/0232465 | A1* | 10/2007 | Puzey | 482/110 |
| 2007/0249468 | A1* | 10/2007 | Chen | 482/8 |
| 2007/0259756 | A1* | 11/2007 | Kuykendall | 482/2 |
| 2007/0275831 | A1* | 11/2007 | Yoshida et al. | 482/63 |

FOREIGN PATENT DOCUMENTS

| | | | |
|---|---|---|---|
| DE | 203 11 319 | U1 | 11/2003 |
| NL | 1008474 | C | 9/1999 |
| NL | 1019154 | | 4/2003 |
| WO | WO 96/36399 | | 11/1996 |
| WO | WO 01/24892 | A2 | 4/2001 |

OTHER PUBLICATIONS

Closed-Loop Force Control for Haptic Simulation of Virtual Environments, Craig R. Carignan and Kevin R. Cleary, Haptics-e, vol. 1, No. 2, pp. 1-14, published Feb. 23, 2000.

An Office Action from U.S. Appl. No. 09/326,941 (2 pgs.).

The Mechanical Efficiency of Treadmill Running Against a Horizontal Impeding Force, B.B. Lloyd & R.M. Zacks, J. Physiol. 1972, 223: pp. 355-363.

Simulation of a Sprinter, Part I. Development of a Model, C.L. Vaughan, Int. J. Biomed. Comput. Jan. 1983; 14(1), pp. 65-74.

Simulation of a Sprinter, Part II. Implementation on a Programmable Calculator, C.L. Vaughan, Int. J. Biomed. Comput., Jan. 1983; 14(1): pp. 75-83.

Neural Adaptations with Chronic Physical Activity, R.M. Enoka, J. Biomechanics 1997, 30(5), pp. 447-454.

Force-Velocity Relations in Human Skeletal Muscle, R.W. Guelch, Int. J. Sports Med. 1994, 15, pp. S2-S10.

Neuromuscular Adaptation during Strength Training, Aging, Detraining, and Immbolization, K. Hakkinen, Crit. Rev. in Physical and Rehab. Med. 1994, 6(3): pp. 161-198.

"Judging the Orientation of Sinusoidal and Square-Wave Virtual Gratings Presented via 2-DOF and 3-DOF Haptic Interfaces", J.M. Weisenberger, M.J. Krier, M.A. Rinker, vol. 1, No. 4, Mar. 28, 2000.

"A Unified Treatment of Elastostatic Contact Simulation for Real Time Haptics", Doug James and Dinesh Pai, vol. 2, No. 1, Sep. 27, 2001.

"Haptic Rendering of Cutting: A Fracture Mechanics Approach", Mohsen Mahvash and Vincent Hayward. vol. 2, No. 3, Nov. 20, 2001.

"Kane's Equations for Haptic Display of Multibody Systems", R. Brent Gillespie, vol. 3, No. 2, Aug. 18, 2003.

"Design and Performance of a Tactile Shape Display Using RC Servomotors (Short Paper)", C.R. Wagner, S.J. Lederman, R.D. Howe, vol. 3, No. 4, Aug. 6, 2004.

"Haptic Simulation of Linear Elastic Media with Fluid inclusions", A.H. Gosline, S.E. Salcudean, J. Yan, vol. 3, No. 5, Mar. 30, 2005.

"The construction of a Haplic application in a Virtual Environment as post-Stroke arm Rehabilitation exercise", Ulrika Dreifaldt & Erik Lövquist, Mar. 23, 2006.

"Arm wrestling with the robots", William Hawrin, Department of Cybernetics, University of Reading, In association with The Oxford Trust for Venturefest 2004, http://www.personal.rdg.ac.uk/~shshawin/hapticsatventurefest.pdf.

Comprehensive Power Meter Review—One Geek Perspective, Take Two, http://www..biketechreview.com/archive/pm_review.htm, Kraig Willet, Mar. 5, 2003.

"Control of Smart Exercise Machines—Part I: Problem Formulation and Nonadaptive Control", Perry Y. Li and Roberto Horowitz, vol. 2, No. 4, Dec. 1997.

Office Action dated May 30, 2008 in U.S. Appl. No. 11/438,715.

* cited by examiner

FIG. 14

BASIC QUATION OF MOTION: V(UPDATE) =V+[(Fa-Ff) - m1* GSIN)] (T inc/m1*).

BIKE EQUATION: V(UPDATE)=V + [Fa-Fd)-(m1 + m2) gsine - 0.5 C, ρ QV$^2$] (Tinc/(m1 +m2))

| INPUT VARIABLES | | | | | |
|---|---|---|---|---|---|
| m1 | MASS OF SUBJECT | m1 | | | |
| Q | CROSS-SECTIONAL AREA OF SUBJECT | Q | SEE NOTES FOR CALCULATING | 0.4 TO 0.7 IS TYPICAL | |
| m2 | MASS OF LOAD (e.g., ENTIRE BIKE) | m2 | APPROX. = 10 KG | | |
| Fd | ADDITIONAL DRAG OF BIKE (ROLLING RESISTANCE + WHEEL ROTATION + DRAG FORCE FRONT & REAR WHEELS) | Fd | | | |
| | (Sn (M1+M2) + 4Ifw/Dfw$^2$+ 4I rw/drw$^2$) + (Cxofw pV Dfw$^2$/8) + (Cx0rwpV Drw$^2$(1-RS)/8)) | | | | |
| | Crr= COEFFICIENT OF ROLLING RESISTANCE | | CRR= .0024 TO .005 | | |
| | Ifw= ROTATIONAL INERTIAL FRONT WHEEL | | STD. RIM 36 SPOKE= 0.0885 | | |
| | Irw= ROTATIONAL INERTIAL REAR WHEEL | | STD. RIM 36 SPOKE = 0.1085 | | |
| | drw= DIAMETER OF FRONT WHEEL | | .674M | | |
| | drw = DIAMETER OF REAR WHELL | | .674M | | |
| | Cx0fw= COEFFICIENT OF DRAG FRONT WHEEL | | CONVENTIONAL = 0.0491 | | |
| | Cx0rw =COEFFICIENT OF DRAG REAR WHEEL | | CONVENTIONAL = 0.0491 | | |
| | RS= EFFECT OF REAR WHEEL SHIELDING BY BIKE FRAME TUBE | | 25% | | |
| $D_T$ OR $T_T$ | TERMINATION VARIABLE (D= DISTANCE, T= DURATION) | $D_T$ OR $T_T$ | | | |
| ρ | AIR DENSITY | ρ | SEA LEVEL = 1.226 KG/M3 | 1500 M = 1.056 | 3000 M = 0.905 |
| CALCULATED VARIABLES | | | | | |
| C1 | DRAG COEF, OF SUBJECT | C1 | | | |
| MEASURED DATA | | | | | |
| V | VELOCITY | V | | | |
| Fa | FORCE (AFT) | Fa | | | |
| CALCULATED DATA | | | | | |
| D | DISTANCE | D | | | |
| V (UPDATE) | VELOCITY | V (UPDATE) | | | |
| A | INITIAL ACCELERATION | A | | | |

VOLTAGE RIPPLE AS A FUNCTION OF TIME FROM A FULL WAVE 3-PHASE ALTERNATOR OUTPUT

POWER RIPPLE AS A FUNCTION OF TIME FROM A FULL WAVE 3-PHASE ALTERNATOR OUTPUT

EXERCISE DEVICE

CROSS-REFERENCE TO RELATED APPLICATION

This application claims the benefit of U.S. Provisional Patent Application No. 60/753,031, filed on Dec. 22, 2005, the entire contents of which are incorporated herein by reference.

BACKGROUND OF THE INVENTION

The present application is related to U.S. Pat. No. 6,676,569, issued Jan. 13, 2004; U.S. Pat. No. 6,454,679, issued Sep. 24, 2002; and U.S. Pat. No. 7,066,865, issued Jun. 27, 2006, and the entire contents of each are hereby incorporated by reference.

Various types of exercise devices such as stationary bikes, treadmills, stair climbers, rowing machines, and the like, have been developed. Such exercise devices mimic a corresponding physical activity to some degree. For example, known stair climbing machines typically include movable foot supports that reciprocate to simulate to some degree the foot and leg motion encountered when climbing stairs. Known stationary bikes typically include a crank with pedals that rotate upon application of a force to the pedals by a user.

Various ways to control the forces generated by such exercise devices have been developed. Known control schemes include constant-force arrangements and constant-power arrangements. Also, some exercise devices vary the force required in an effort to simulate hills or the like encountered by a user. However, known control schemes/methods do not provide force feedback that realistically simulates the forces encountered when performing the actual physical activity to be simulated.

Accordingly, a control system and exercise device that alleviates the problems associated with known devices would be advantageous.

SUMMARY OF THE INVENTION

The present invention relates to a control system and method for exercise equipment and the like. The present invention provides a way to simulate a physical activity in a manner that takes into account the physics of the physical activity being simulated. According to one aspect of the present invention, the control system and method takes into account the physics of the corresponding physical activity to generate a virtual or predicted value of a variable such as velocity, acceleration, force, or the like. The difference between the virtual or expected physical variable and a measured variable is used as a control input to control resistance forces of the exercise equipment in a way that causes the user to experience as forces that are the same or similar to the forces that would be encountered if the user were actually performing the physical activity rather than using the exercise equipment.

One aspect of the present invention is a stationary bike including a support structure defining a front portion and a rear portion. The stationary bike includes a seat mounted to the support structure and a crank rotatably mounted to the support structure for rotation about an axis. The crank includes a pair of pedals that are movable along a generally circular path about the axis. The circular path defines a forward portion in front of the axis, and a rear portion in back of the axis. The stationary bike includes a control system having a force-generating device such as an alternator, mechanical device, or the like that is connected to the crank to vary a resistance force experienced by a user pedaling the stationary bike. A controller controls the force-generating device and will in many/most instances similar to riding an actual bike cause the resistance force experienced by a user to be greater in the forward portion of the circular path than in the rear portion of the path.

Another aspect of the present invention is a stationary bike that substantially simulates the pedaling effort of a moving bicycle. The stationary bike includes a support structure and a pedal movably mounted to the support structure. The pedal structure includes two pedals that move about an axis to define an angular velocity. Forces applied to the pedals by a user define user input forces. The stationary bike further includes a controller that is operably connected to the pedal structure to provide a variable resistance force restraining movement of the pedals in response to user input forces. The variable resistance force substantially emulates at least some of the effects of inertia that would be experienced by a rider of a moving bicycle.

Another aspect of the present invention is an exercise device including a support structure and a user interaction member movably connected to the support structure for movement relative to the support structure in response to application of a force to the user interaction member by a user. The exercise device further includes an alternator operably connected to the user interaction member. The alternator provides a variable force tending to resist movement of the user interaction member relative to the support structure. The variable force varies according to variations of a field current applied to the alternator, and the variable force is substantially free of undulations related to voltage ripple.

These and other features, advantages, and objects of the present invention will be further understood and appreciated by those skilled in the art by reference to the following specification, claims, and appended drawings.

BRIEF DESCRIPTION OF THE DRAWINGS

FIG. 14 is a table showing an equation of motion that may be utilized in a control system for controlling a stationary bike according to one aspect of the present invention;

DETAILED DESCRIPTION OF THE PREFERRED EMBODIMENT

Figure 1C:
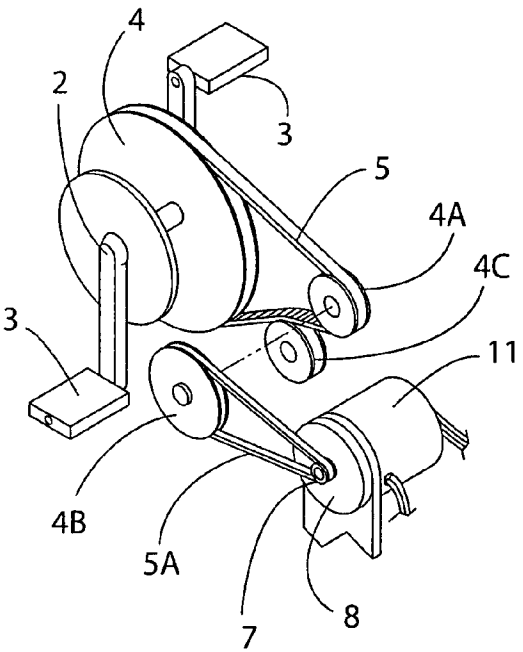
FIG. 1C is a partially fragmentary perspective view of a portion of the exercise device of FIG. 1.

The present application is related to U.S. Pat. No. 6,676,569, issued Jan. 13, 2004; U.S. Pat. No. 6,454,679, issued Sep. 24, 2002; and U.S. patent application Ser. No. 10/724,988, filed on Dec. 1, 2003, and the entire contents of each are hereby incorporated by reference.

One aspect of the present invention is a control system/method for controlling an exercise device or the like. The control system/method can be utilized to simulate virtually any dynamic system. Another aspect of the present invention is an exercise device such as a stationary bike 1 (FIG. 1) that includes a dynamic system control that simulates riding a bicycle. The present invention provides a unique way to control an exercise device to more accurately simulate the dynamics of the exercise being simulated.

Various types of exercise equipment have been developed in an attempt to imitate the dynamics of conditions with which the exercising person is familiar. Such devices provide a very limited simulation of the actual activity. For example, stair climbing exercise equipment provides motion that is somewhat similar to that encountered when climbing stairs. Walking equipment (e.g., treadmills) provides a walking movement, and stationary exercise bikes provide leg movement that is similar to the leg movement when riding a "real" bicycle.

Although known exercise devices may provide a range of movement that is somewhat similar to that of an actual device or activity, known exercise devices do not accurately simulate the forces normally experienced by a user due to the dynamic effects of the activity, and the inability of these exercise devices to accurately simulate the Newtonian laws of motion.

Heretofore, known exercise equipment did not simulate the dynamics of the actual activity/device. Known exercise devices may include constant force, constant velocity or constant power control schemes. Such devices do not provide an accurate simulation of the actual device/activity. Thus, a new user will not be familiar with the equipment movement behavior, resulting in a less realistic and less effective experience, and not be as biodynamically correct. Also an inaccurate simulation may not provide proper loading for the user's muscles to maximize transference, or adaptation to the actual activity being trained. For example, the forces and speeds of walking equipment should accurately simulate the act of walking, since the human body is adapted for this form of exercise. Similarly, a stationary bike should recruit the muscles as appropriate for actual biking.

Familiarity with the equipment behavior is not the only advantage of making exercise equipment dynamically correct (i.e., accurately simulating the actual exercise). In order to provide optimum athletic advantage and performance for the user, the muscles of the exercising person should be challenged by the equipment in a way that requires the muscles to operate normally (i.e., in a natural manner). For example, the user's muscles may require periodic rest phases on each exercise stroke or cycle to produce normal blood flow and oxygenation of the muscles. Also, a user's perception of effort for a given amount of power may be minimized by using the muscles in a normal dynamic manner, and a user may thereby be able to exercise more effectively or longer with the same perceived effort if the machine provides accurate resistance forces simulating to actual physical activity.

Known exercise equipment may utilize motors, brakes, or other electrical devices or mechanical devices that provide resistance to the user. Such equipment typically includes mechanical devices that look and/or move somewhat like an actual activity. Known control schemes for exercise devices typically utilize constant force or constant torque, constant power, constant speed, or other simple control parameters to control levels or resistance settings of the exercise device. The human body, however, typically does not operate under such artificial load conditions. Typical muscle recruitment and resulting human movement creates inertial/momentum effects that may include high-output and low-output power on a given cycle or stroke during each exercise movement. For example, one type of stationary exercise bike utilizes a constant power load to create and or control the resistance force. The constant power load may be modified somewhat by a flywheel to sustain momentum throughout a given exercise cycle or stroke. Without the flywheel, a constant power stationary bike would be very difficult to ride and would feel to a user as if they were pedaling up a very steep hill, or under water, unable to gain momentum. Nevertheless even with a flywheel normal or correct inertial characteristics are only achieved at one pedal rate and power level. As a result, known stationary exercise bikes do not feel like a real bicycle to a user, and may seem more like pedaling a bike with the brakes on with any appreciable level of resistance force. When riding a "real" bicycle, the rider generates momentum and builds up speed, wherein the downward power stroke generates accelerations in the bike and the rider's muscles that carry them into the next pedal stroke. These normal conditions are not constant power, constant force, or any other simple control function utilized in known exercise systems. Rather, the actual conditions include a complex interaction between the rider's applied force, the bike and rider's weight, the slope of the road, the road smoothness, wind resistance, the bike speed, and other factors.

Figure 19:
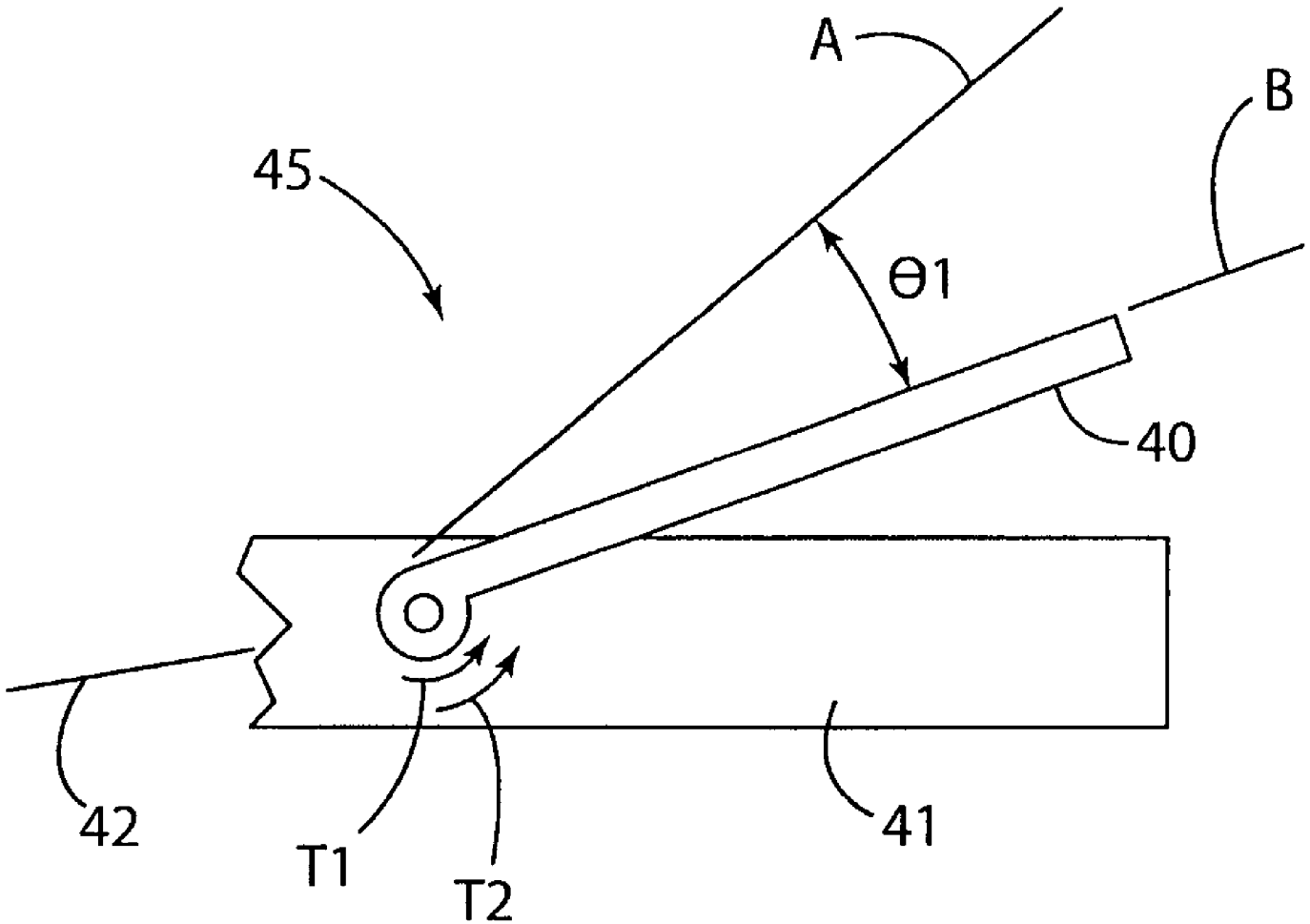
FIG. 19 is a partially schematic view of a brake lever that can be manipulated by a user to control the virtual velocity of a stationary bike according to another aspect of the present invention.

Also, the speed of the body while walking on a stationary surface is not constant as opposed to the velocity of a treadmill belt or conveyor. Not only do speed changes occur due to slope changes and user fatigue and strength, but also on each step the user's body is accelerated forward during the muscle power stroke and then carried forward by the body's momentum into the next step. Thus, operating a walking machine at constant speed is dynamically inaccurate and non-optimum for the user's muscles. The control arrangement of the present invention can be utilized to control exercise devices such as those discussed above, and also to control rowing machines, weight lifting machines, swimming machines, tennis or baseball practice machines, or any other machine or device used to simulate an exercise or other physical activity. In one aspect, the present invention utilizes unique control loops to determine the correct resistance force to put on the user at any given time, and to rapidly adjust the forces during the power stroke and/or return stroke to optimally load the muscles and accurately simulate the actual forces that would be experienced by the user performing a given physical task. One aspect of the present invention is a unique control system by which complex conditions can be simulated by electrically-based load devices such as eddy current brakes, motors, or alternators. Alternately, other force-generating devices such as mechanical brakes or the like may be utilized instead of, or in conjunction with, an alternator or other such electrical force generating device. Numerous types of mechanical brakes are known, such that the details of all suitable brake arrangements will not be described in detail herein. Nevertheless, in general, most such mechanical brakes (e.g., disk brakes, calipers, drum brakes, etc.) include a friction member that is movable to engage another brake member that moves as the pedals and/or other moving drive train parts of the stationary bike move. If the mechanical brake is controlled by the control system, a powered actuator may be operably connected to the movable friction member such that the controller can generate a signal to the powered actuator to engage the friction member with the other brake member to provide the desired amount of resistance force to simulate the physical activity. The brake may also receive a control signal from a hand brake lever (FIG. 19) either directly or through the controller to vary the resistance force. Alternately, a hand brake lever as shown in FIG. 19 may solely provide a "virtual" brake signal to the controller, with the controller using the signal to adjust the virtual velocity of the bike road model.

For purposes of the discussion below, a stationary bike 1 (FIG. 1) will be used by way of example, but the reader will readily understand that the concepts, methods and control system can be utilized with virtually any type of exercise machine to simulate any type of physical activity or motion. For example a dynamically accurate walking machine according to the present invention mimics the changes in momentum experienced by the walker, and adjusts the forces to simulate the walker's velocity.

The system/method/exercise equipment of the present invention provides a physical experience for the human user that may be almost identical to a rider's experience on a real bike, including the forces applied and the feel of the pedal power stroke and the periodic variation of forces and/or velocity as the pedals rotate.

Figure 1:
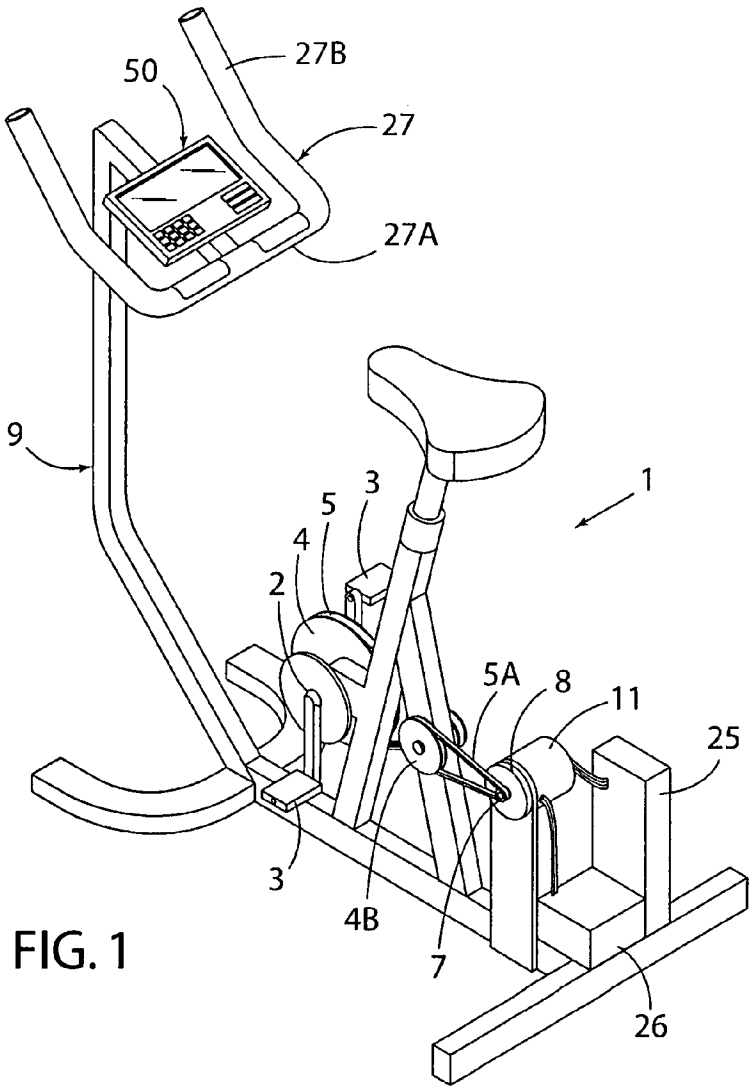
FIG. 1 is a perspective view of an exercise device according to the present invention.
Figure 11:
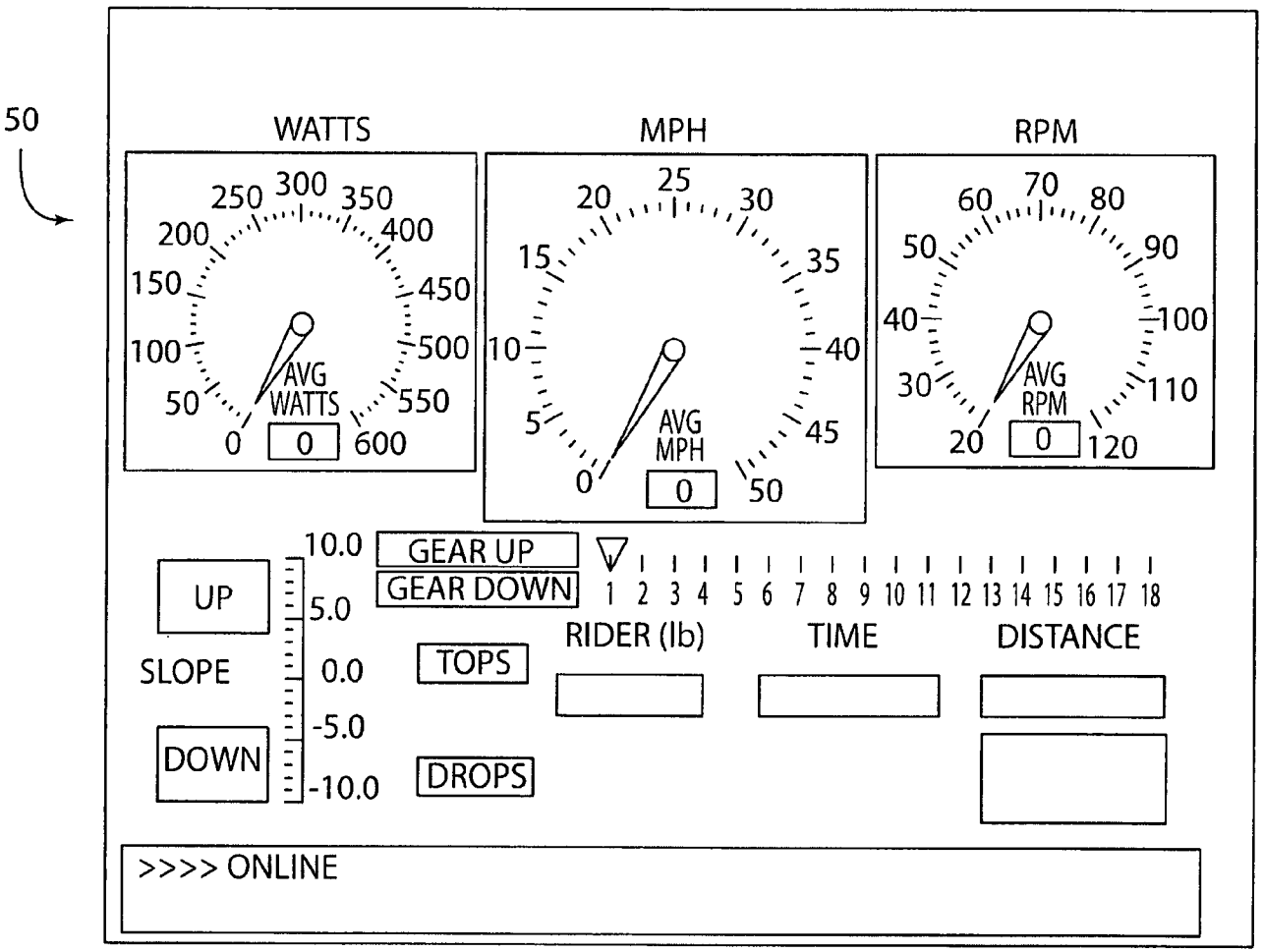
FIG. 11 is a display viewable by a user of an exercise device according to one aspect of the present invention.

With reference to FIGS. 1 and 1C, a stationary bike 1 according to one aspect of the present invention includes a crank 2 that is rotatably mounted to a support structure such as a frame 9. Crank includes a pair of pedals 3 that move about the crank axis in a generally circular path. A drive member 4 such as a pulley, gear, or the like is connected to the crank 2, and drives a flexible drive member 5. The flexible drive member 5 may be a belt, chain, or the like, or other suitable device or structure. In the illustrated example, flexible drive member 5 rotates a pulley or drive member 4A that is rotatably mounted to the frame 9. Pulley 4A is fixedly connected to a pulley 4B, such that rotation of pulley 4A rotates pulley 4B, and thereby moves a second flexible drive member 5A. A pulley 4C maintains and/or adjusts tension of drive member 5. The second flexible drive member 5A rotates a driven member such as a pulley 7. A sensor such as an encoder 8 is configured to detect the position and/or movement of the driven member 7. Because the size of the drive members 4, 4A, 4B and driven member 7 are known, the rotation rate of crank 2 can be determined from data from encoder 8. An alternator 11 is also connected to the driven member 7. As described in more detail below, an electronic control system 25 utilizes information from the encoder 8 or other sensors (e.g., force sensors) to control a resistance force generated by the alternator 11. The resistance forces generated by the alternator 11 felt by a user exerting force on the pedals 3. As also described in more detail below, the control system of the present invention utilizes one or more factors related to an actual physical activity (e.g., riding a moving bike) to determine the resistance force generated by alternator 11. As also described in more detail below in connection with FIG. 11, the electronic control 25 may be configured to provide information that is shown on a display screen 50. This information may include the rider's power output, the rider's velocity (i.e., virtual velocity), the crank r.p.m., and the slope of a virtual hill that the rider is encountering. Still further, the display 50 may display the gear of the bike, the ride time, the distance traveled, or the like. Handlebars 27 of bike 1 may include upper portions ("tops") 27A and "lower" portions ("drops") 27B. The tops 27A and/or drops 27B may include sensors that determine which portions of the handlebars 27 a user is grasping. As discussed below, the control system may use this information to adjust an aerodynamic drag factor to account for the different aerodynamic drag of the rider in each position. In general, bike 1 will provide greater resistance force at a given virtual velocity when a rider is using tops 27A relative to the resistance force generated when a rider is using drops 27B. Display 50 may include a feature that indicates if the rider is currently using tops 27A or drops 27B. As also discussed in more detail below, bike 1 may include a battery 26 that is charged by the alternator 11 in response to control signals from the electronic control 25. It will be apparent that a stationary bike 1 according to the present invention does not necessarily need to include a flywheel or other momentum storage device to account for variations in rider input force or the like. For those reasons discussed in more detail below, the A control system according to the present invention provides for simulation of an actual physical activity in a way that eliminates or reduces the need for flywheels or other devices that would otherwise be required to account for the affects of momentum that occur during the actual physical activity being simulated.

Figure 1A:
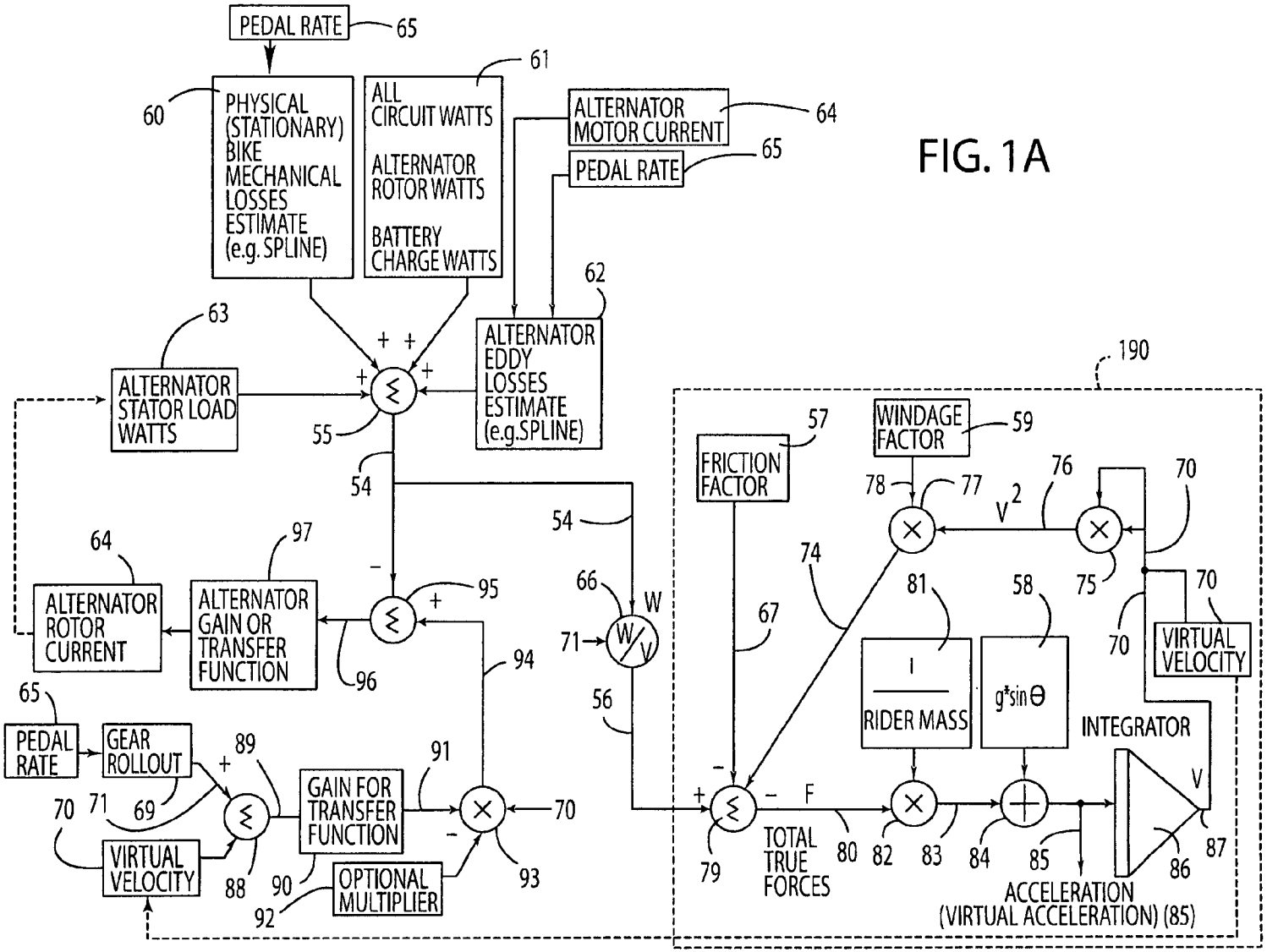
FIG. 1A is a schematic diagram of a control system and method for exercise devices according to one aspect of the present invention.

FIG. 1A is a block diagram of a control system/method for exercise equipment. In the illustrated example, the exercise equipment comprises a stationary bike. FIG. 2 is a diagram showing how the control system/method can be utilized to control virtually any mechanical axis, accounting for user position input, user power, internal power losses, momentum gain and loss, and other factors. Significantly, FIG. 2 shows one way that the method can be completely generalized by knowing the physics of the conditions on the user. Each of the forces represented in FIGS. 1A, 1B, 2 and 2A may be determined by measuring forces on actual bikes (i.e. empirical data) under various operating conditions, or from other actual exercises or physical activities. The actual forces for various rider weights under various conditions can be measured and utilized to generate a data base that is accessed by the system controller to set the control system for an individual user. The controller may be programmed to calculate a curve fit or an interpolation scheme to provide numerical values for the control variables in areas of operation (i.e. riding conditions) for which empirical data is not available. Such measured forces generally correspond to terms in the equations of motion for a particular activity. For example, an equation of motion for a biking scenario is described in more detail below (Equation 1.2). The equation of motion for a bike includes terms for forces due to aerodynamic drag, friction/rolling drag, hill angle, and dynamic forces under acceleration due to the bike's mass and rotational inertia. Preferably, all sources of acceleration are added up, and this sum is integrated to give a virtual bike velocity, following the equations F=MA and V=Integral[AdT]. It will be understood that although any one acceleration source, or any combination of the sources of acceleration may be utilized, this will tend to result in a simulation that is less realistic.

As also described in more detail below, an additional force may result from application of the brakes on the bike. These terms correspond to the empirical terms discussed above. Similarly, equations of motion can be developed for other physical activities or exercises and utilized to implement the control system of the present invention utilizing the approach described herein for a bike. Alternately, the actual forces encountered during a given physical activity can be measured and used to implement a control system utilizing an empirical approach as described herein. Still further, a "blended" or combination approach may be utilized wherein some of the terms utilized for control are based on measured values, and other terms are calculated using the analytical approach. For instance multiple axes, with multiple control loops, can be implemented in the case of complex motions, in such a way the user experiences each movement as being dynamically "correct" or normal. An example might be a swimming machine, where each limb is either in contact with the water or not, and the water causes drag on the immersed limbs, and the speed of the swimmer would have momentum that carries the swimmer into the next stroke. Each limb would have a control system that handles that limb's conditions, speeds, immersion, and other factors. Each limb would contribute to the forward momentum of the swimmer, and experience loss from water turbulence. It should be understood this is merely another example of the use of the simulation method and control system described herein.

Sensors not described in the basic functionality of this method can be helpful, but not necessary, to the function of the exercise equipment. For example, a force sensor that is operably connected to the pedals of an exercise bike can make the measurement of user effort/force more accurate than calculating the force based on user watts effort and estimated losses due to stationary bike components that result in bike mechanical losses, eddy currents, and other electrical losses. The control system may operate as described: a velocity difference between user input and control system computed speed is used to control the braking device on the user. The force sensor, by way of example, may change the way the control system updates its acceleration and thereby velocity internally. The underlying control principle may remain the same.

Implementation of a dynamic system control that simulates a physical dynamic device according to the present invention preferably includes meeting a number of control conditions. However, the present invention includes control systems, methods, and devices that do not completely meet all control conditions. It will be understood that all aspects of the control systems described herein do not need to be included to provide a control system according to the present invention.

For example, simulating an actual bicycle may include accounting for rolling resistance/friction, aerodynamic drag, acceleration or rider weight. Nevertheless, the present invention contemplates that not all of these factors need to be included to provide a simulation that feels quite realistic to a user of a stationary bicycle or other exercise equipment. Also, some factors need not be precisely accounted for to provide an adequate simulation. For example, the aerodynamic loss can be modeled quite accurately if the coefficient of drag and surface area of a specific rider is known. However, the effects of aerodynamic drag can be taken into account using a set (i.e., the same) surface area and coefficient of drag for all users. Although the magnitude of the aerodynamic drag experienced by a given user may not be precise, an increase in pedaling resistance due to increased rider velocity will be experienced by a user. Similarly, although each rider's actual body weight may be entered into the control system to accurately simulate the forces due to hills, acceleration, rolling resistance, and the like, the same rider weight may be used for all users. Although the total resistance forces experienced by a given user will likely be at least somewhat inaccurate if the weight of the individual user is not utilized by the control system, the rider will still experience variations in force due to hills, acceleration, and the like. This provides a somewhat simplified way to simulate actual bicycle riding conditions without requiring input of the weight of a given user. It will be further understood that the input of variables such as rider weight may be simplified by providing a choice of input weights/ranges such as "low rider weight," "medium rider weight," and "high rider weight." In this example, the system utilizes a single numerical weight associated with each weight range. Also, such interactions such as how the rider's weight affects windage loss can be taken into account.

Still further, it will also be understood that the actual terms from the equation of motion for a specific physical activity do not need to be utilized if a highly accurate simulation is not desired or needed. For example, in general the aerodynamic drag is a function of the velocity squared. However, the effects of aerodynamic drag could be calculated utilizing velocity raised to the 2.10 power or other power other than velocity squared. Although accurate simulation of the physical activity may be preferred in many situations, the present invention contemplates variations including equations, formulas, rules, and the like that may not utilize the actual equation of motion for the physical activity being simulated. The principles and concepts of the present invention may be utilized to simulate the physics of an actual physical activity in by taking into account the factors affecting the forces experienced by user without using the actual equations of motion, or using equations of motion that capture the non-ideality of real systems. According to one aspect of the present invention, the dynamic conditions of the system are simulated arithmetically in a control loop, the dynamic system power losses and gains associated with the user are distinguished from other losses and gains applied to the user power input, and a control signal to an electronic brake or the like is generated to control the forces on the user.

In general, when a user interacts with the environment in a way that uses significant user power, there are virtually always factors such as the speed and momentum of objects with which the user interacts. Thus, one aspect of an accurate simulation is to simulate the mass and momentum of objects that the user interacts with. The mass and momentum effect is frequently a very important dynamic element, because muscles are often recruited explosively, to rapidly put energy into overcoming inertia, and the momentum assists completion of the remaining portion of the exercise stroke or cycle. This dynamic action occurs on a "real" bicycle when the user generates a high force on the down stroke and then less force on the upstroke. Simulating the bike momentum achieves this effect. The following is a description of one aspect of the present invention, using a bicycle simulation by way of example. FIG. 1A shows a loop control diagram for a stationary bicycle having a control system that simulates actual riding forces, accelerations, and the like experienced by a rider on a real bicycle.

One aspect of the present invention is a software control system that incorporates a control system to simulate the dynamics of an actual device. A bicycle simulation according to the present invention (FIG. 1A) includes generating a virtual "bike velocity." The virtual bike velocity, as on a real bicycle, is modified by the power inputs to the system. (The virtual "bike velocity" has no physical reality, it is just a computed number.) The velocity is increased by going down a hill, or by the rider applying sufficient torque to the pedals. The velocity is decreased by aerodynamic loss (also referred to herein as "windage loss"), friction, or going uphill on the bicycle. Similarly, when walking there is a walking speed; when hitting a baseball with a bat, there are rotational, vertical and horizontal bat speeds.

Referring again to FIG. 1A, a control system/method according to one aspect of the present invention separates the system losses and gains into those that are directly applied to the user as force and power demand from the user from those losses that are not directly applied to the user. In the case of a bicycle, an example of a force directly applied to the user is the rider's application of torque on the pedals. This torque multiplied times the rotation rate is the user input power. Examples of system losses and gains that are not directly applied to the user would be windage loss, friction loss, power going into raising the bike on an uphill slope, and power going into accelerating the bike. These "virtual" forces and/or power losses/gains are not directly applied to the rider, but rather they are inputs to the bike road model 190 of the dynamic system control that eventually affect the rider torque. These indirect or virtual forces are applied to the acceleration and deceleration of the effective (virtual) bike speed computed by the control system. These virtual forces indirectly affect the actual forces experienced by the rider because they modify the dynamic system control speed, and user input of force is necessary to increase or decrease this speed by pedaling. With reference again to FIG. 1A, the friction factor 57, slope 58, and aerodynamic drag factor 59 are not applied to the rider directly. Rather, these factors are taken into account by the bike road model 190 portion of the system and applied to the increase and decrease of the calculated virtual bike velocity through positive or negative acceleration. In absence of actual rider input forces, the control system "decelerates" the virtual velocity. If the rider is to keep this internal "speed" up, the rider must pedal. This aspect of the control system provides a much more realistic simulation of an actual bicycle. For example, if a rider of a stationary bike utilizing the control system of the present invention stops pedaling for a moment, upon resuming pedaling the rider will need to pedal at a rate equal to the virtual velocity of the bike before experiencing significant resistance force on the pedals. In this way, the user can "coast" as needed to rest from time to time without immediately experiencing full resistance force from the pedals even at very low pedal speeds upon resuming pedaling. It will be appreciated that prior constant force and constant power control schemes do not provide a realistic coasting experience. Although prior control arrangements may include a flywheel that retains some momentum, such systems do not accurately take into account the drag forces and the like of an actual bicycle, such that the forces experienced by a user of a prior flywheel type system will be quite different than would be experienced riding a real bicycle. In a control system/method according to the present invention, almost all mass and momentum is simulated such that a flywheel is not needed. In general, all real physical mass and momentum buildup in the equipment is minimized or avoided so it does not interfere with the simulation to an appreciable degree.

Rider input power 54, and therefore rider force 56, is calculated by adding up the losses in the real physical mechanism and the electrical power generated by the rider at diagram summation element 55. For example, when an alternator is used as an electrically controlled brake, the bike simulator has estimated mechanical losses 60, electrical losses 61 including estimated alternator eddy current losses 62 and estimated battery charging losses. As shown in FIG. 1A, alternator rotor current 64 and pedal rate 65 are utilized to estimate the eddy losses of the alternator. Methods for estimating eddy current losses are known. For example, the alternator could be tested to determine a mathematical relationship or a look-up table. As also shown in FIG. 1A, the alternator rotor current 64 may also be utilized to determine the alternator stator load (watts) for input to summation element 55. Pedal rate 65 is also utilized to estimate the mechanical losses 60 of the stationary bike. Although this mechanical loss could be estimated or measured in a variety of ways, in the illustrated example, the mechanical losses of the stationary bike under various operating conditions are measured. A spline or other curve fitting algorithm is utilized by the system to generate a mechanical loss estimate for the operating conditions (e.g., pedal rate). These losses in addition to the main "loss," which is electrical power 63 generated by the rider through current generated in the alternator output 64. The total of these real power losses is taken as the rider's power input that modifies the virtual bike velocity.

Figure 8:
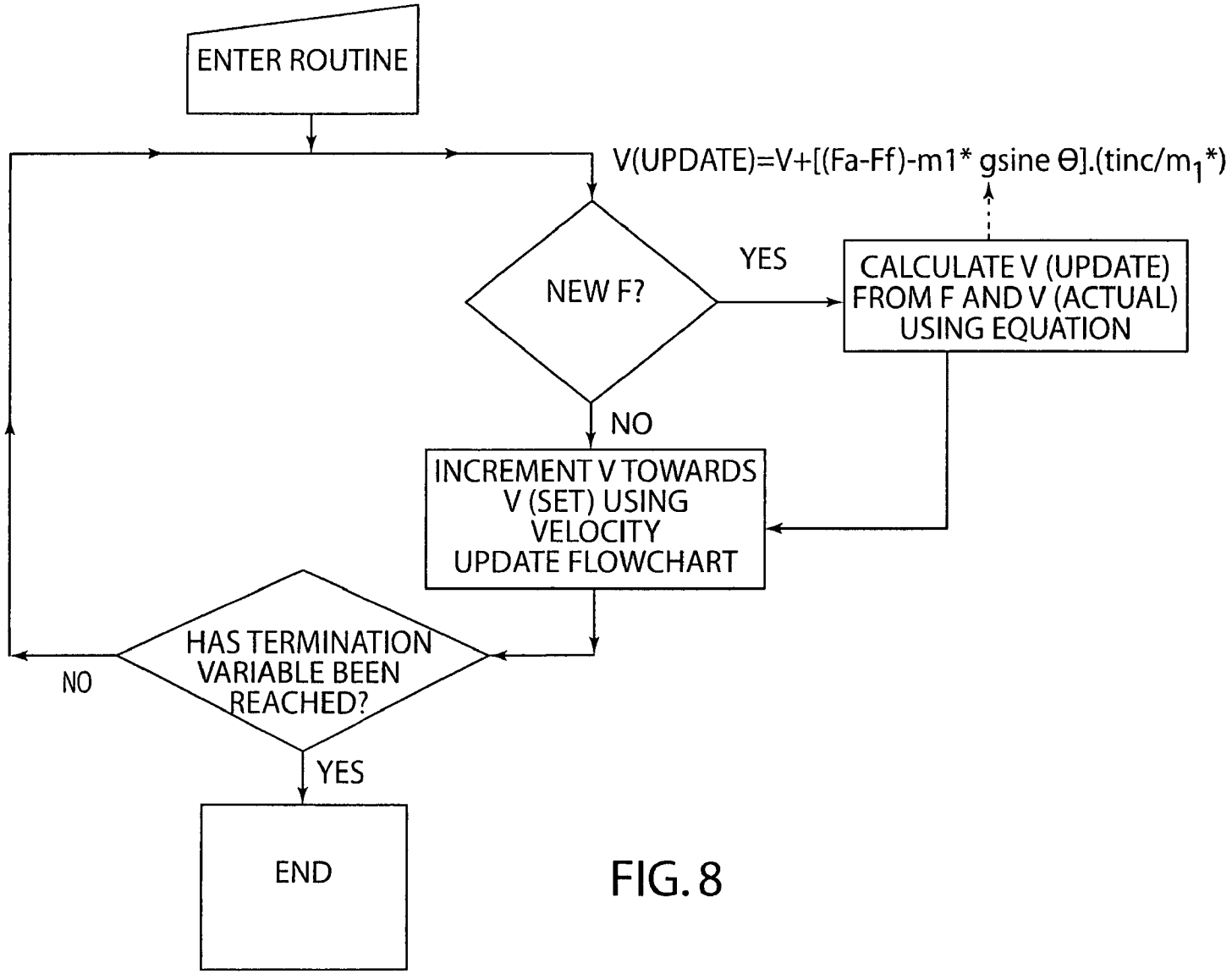
FIG. 8 is a diagram illustrating a routine that may be utilized in a control system according to the present invention.
Figure 9:
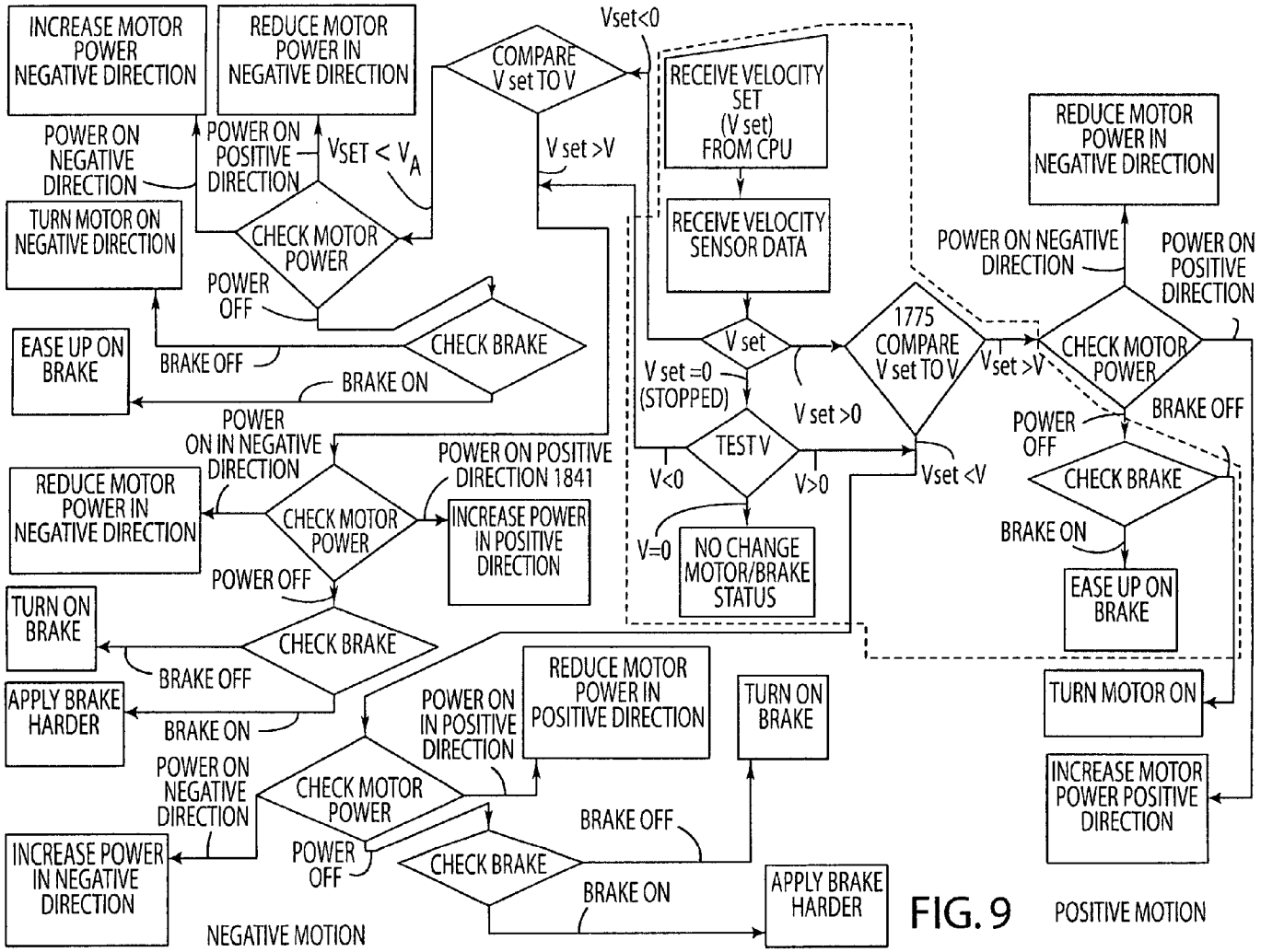
FIG. 9 is a diagram illustrating a routine that may be utilized in a control system according to another aspect of the present invention.
Figure 10:
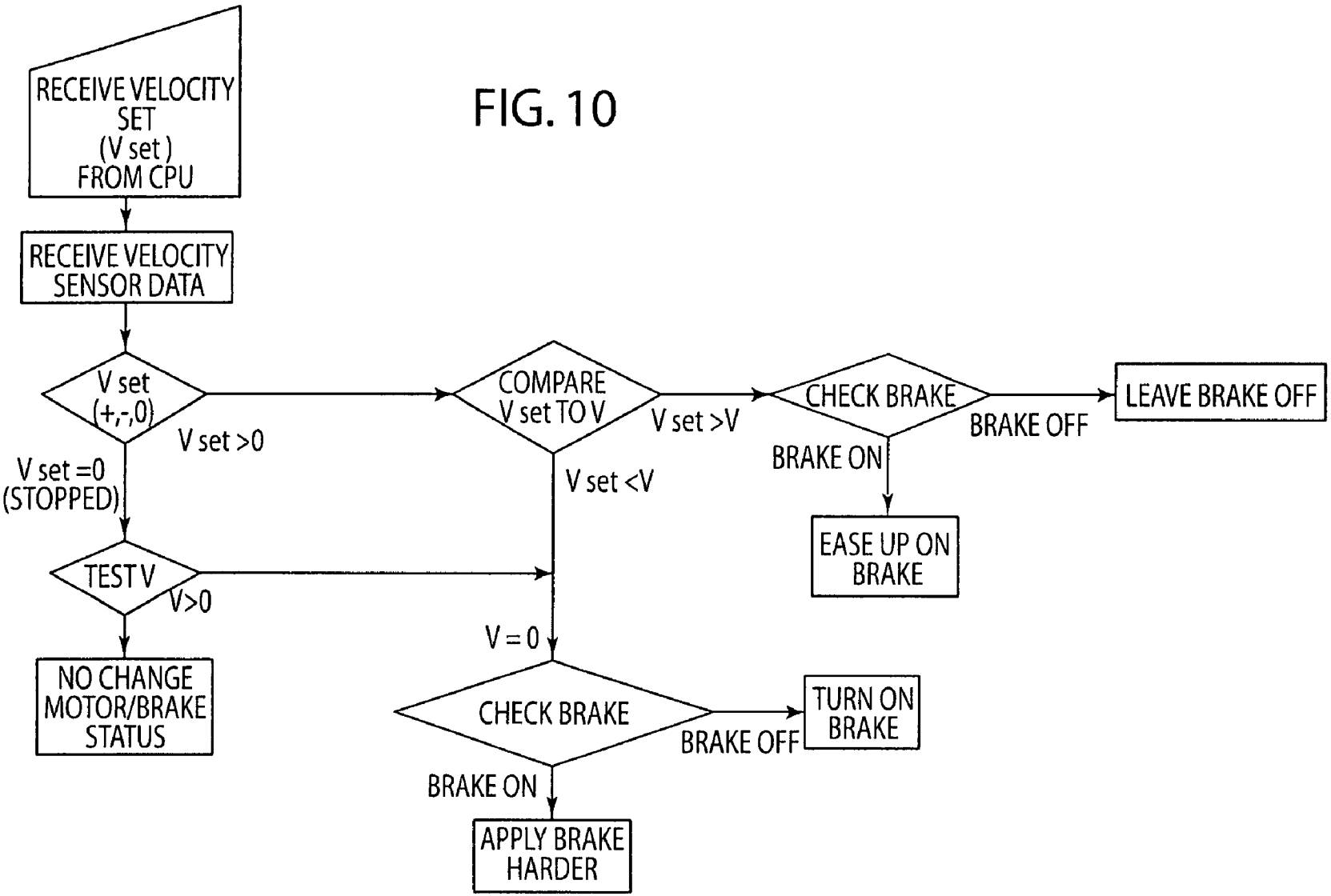
FIG. 10 is a diagram illustrating a routine that may be utilized in a control system according to another aspect of the present invention.

In FIG. 1A, the pedal rotation rate 65 is measured with a sensor, and the bike simulation's "gear rollout" 69, that is, meters of forward motion for each rotation of the pedals, for each gear, is known. Since the rider's measured bike forward velocity 71 (measured pedal rate 64 times rollout 69) and the total pedal power 54 applied are known, the estimated rider force 56 can be calculated by dividing total rider true watts 54 ("W") by the measured bike velocity 71 (V) at diagram element 66 to determine estimated rider forces 56. The "virtual" friction losses 67 are calculated using the virtual bike velocity 70 at diagram element 57. As described in more detail below in connection with FIG. 8, the frictional (rolling) losses of the virtual bike may be calculated or determined in a variety of ways. As also described in more detail below, the virtual aerodynamic drag force (loss) 74 may be determined in a variety of ways. In general, the virtual velocity 70 is squared as shown at diagram element 75 to form virtual velocity squared 76. The square 76 of the virtual velocity 70 goes into diagram element 77. Diagram element 77 includes a mathematical formula, look-up table based on empirical data, or other rule or information that is utilized to determine the "virtual" aerodynamic drag 74. In the illustrated example, the factor 78 is equal to $-0.5C_{1\rho}Q$. This and other factors affecting the virtual velocity are discussed in more detail below in connection with FIG. 8.

The estimated rider forces 56, friction losses 67, and aerodynamic losses 74 are added together at diagram element 79 to provide the total "true" force 80. The total true force 80 is multiplied times the inverse 81 of the rider mass at diagram element 82 to generate a first acceleration value 83. The first acceleration value 83 is increased or decreased at diagram element by adding the slope factor 58 to provide the total "true" (virtual) acceleration 85 of the virtual bike and rider. The total acceleration 85 is integrated at integrator 86 to provide the virtual bike velocity 90 at the output 87 of the integrator 86.

An electronic brake or the like may be utilized to provide a variable resistance force to the user. The electronic brake may comprise an alternator that utilizes a control input to provide the desired force to the user. In the illustrated example (FIG. 1A), this control input is generated by taking the difference between the measured velocity 71 and the virtual velocity 70. The measured velocity is the pedal rate 64 times the gear rollout 69, and the virtual bike velocity 70 is produced by the integrator 86. In the illustrated example, the difference between the virtual velocity 70 and the measured velocity 71 occurs at diagram element 88. The result is a velocity difference value 89 (it will be understood that the virtual velocity value 70 from integrator 86 is stored internally in the control system). On a real bike, when the rider is applying force to the pedals to move a bike forward, these two speeds are the same when forces are constant, but in actual fact the bike acts as a spring and as this spring winds up, force is applied to the pedal. So, in fact, a real bike works by the same mechanism of speed differences, although on a real bike these differences are subtle. In the simulation/control system/method according to the present invention, these speed differences are preferably very small as a result of the control system, similar to a real bike. It has been found that the control system, however, need not be as "stiff" as real bike to provide a good simulation. In the simulation, the velocity difference 89 between the measured velocity 71 and the virtual velocity 70 is multiplied by a relatively large number and fed into the electronic brake (e.g., alternator) control. In the system of FIG. 1, the output 91 is multiplied by an optional multiplier 92 and the virtual velocity 70 at diagram element 93, and the result 94 (in watts) is added to the rider input power 54 at diagram element 95. The result 96 of the summation 95 is input to an alternator gain or transfer function 97 to provide input for the alternator rotor current 64. If the pedal apparent speed (measured velocity 71) is faster even by a small amount than the internal control speed (virtual velocity 70) of the control system, a great amount of current is applied to the electronic brake input, and the rider feels large forces resisting motion on the pedals. However, the difference in velocity between the measured velocity 71 and the virtual velocity 70 is preferably very small and therefore imperceptible to a rider.

The pedal apparent speed (measured velocity 71) is preferably known (measured or calculated) with high precision, because the difference 89 between two relatively large numbers is used to determine the control input to the electronic brake. For example, if for the bike we expect the pedal apparent speed (measured velocity 71) and the internal control speed (virtual velocity 70) to be the same within 0.1 mile per hour (for a bike simulation this speed difference is generally imperceptible to a rider), a resolution of at least about 10 to 100 times 0.1 (i.e., 0.01 to 0.001 mph) provides control of the electronic brake that is smooth, without a "cogging" feel to the rider. It will be understood that even higher resolutions may also be utilized. Thus, the speeds of the bike control system and the pedal apparent speed are preferably very high resolution to ensure the simulation is accurate.

Multiplying the velocity difference 89 by a relatively large number may be thought of as being somewhat similar to the proportional gain control of a Proportional-Integral-Derivative (PID) controller. In general, PID controllers output a control variable that is based on the difference (error) between a user-defined set point and a measured variable. However, rather than using an error that is the difference between a measured value and a set point, the controller of the present invention utilizes the difference between a measured variable such as velocity and a "virtual" set point that is continuously and rapidly recalculated utilizing the equations of motion for the device/exercise/activity being simulated. The PID system captures or utilizes the behavior of the real exercise equipment, for example, the spring windup effect in a bike frame.

Figure 1B:
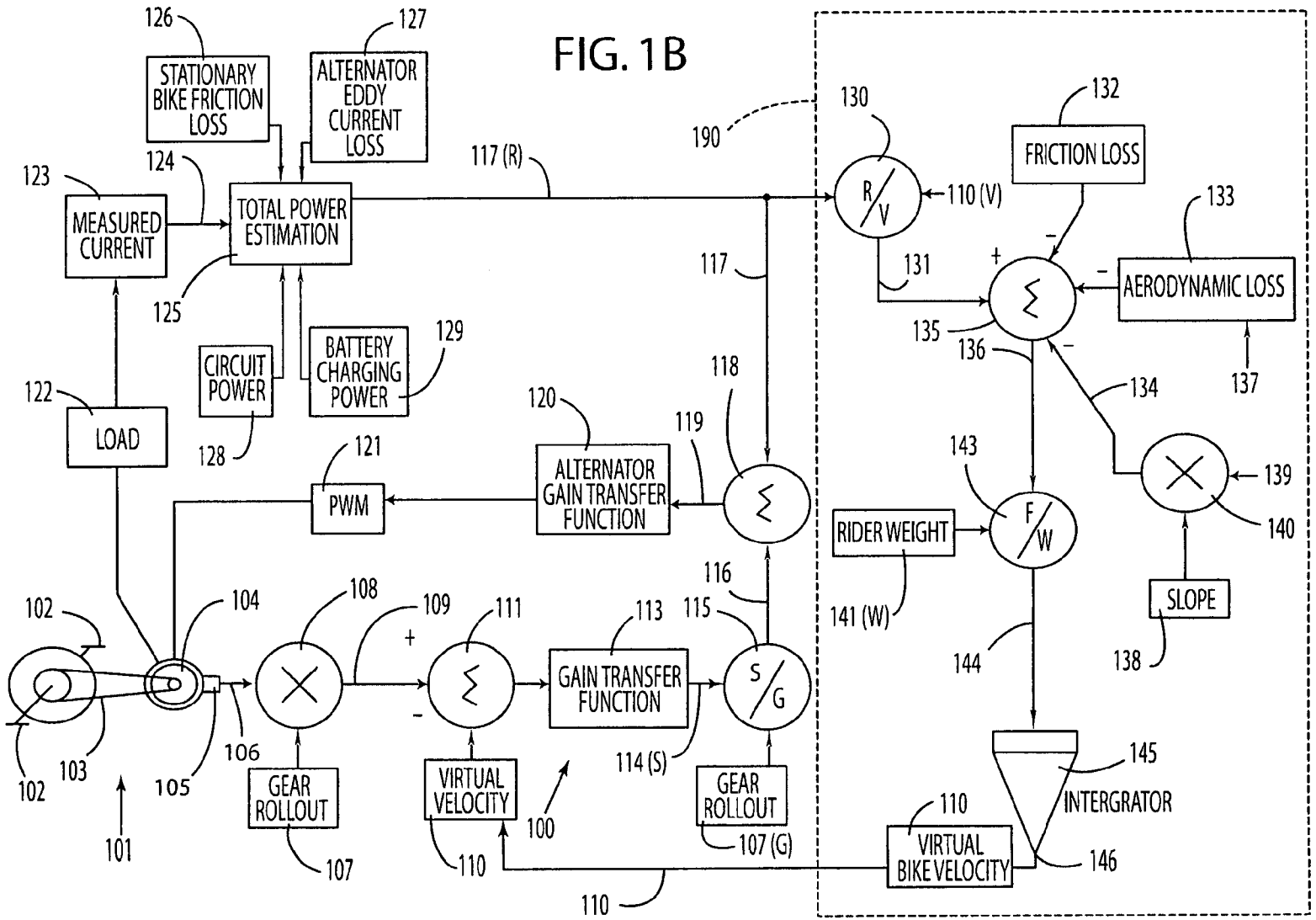
FIG. 1B is a schematic diagram of a control system and apparatus according to another aspect of the present invention.
Figure 2:
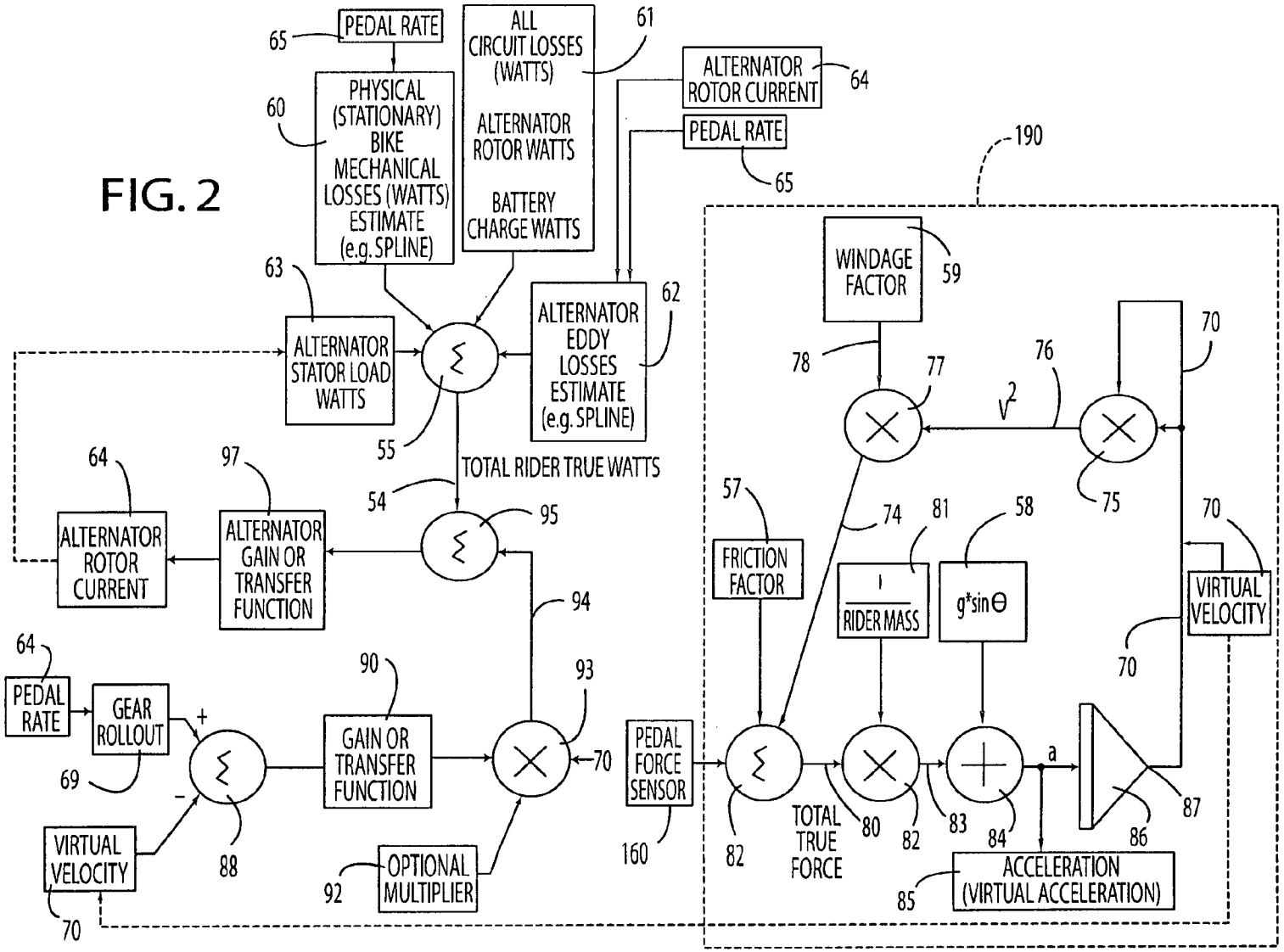
FIG. 2 is a schematic diagram of a control system and apparatus according to another aspect of the present invention.

FIG. 1B is a diagram showing a control system 100 according to another aspect of the present invention. A stationary bike 101 includes pedals 102 that drive a connecting member such as a belt or chain 103. The chain 103 drives a rotor 104 that is connected to an alternator or the like to provide a variable resistance force. A sensor such as an encoder 105 provides position and/or velocity and/or acceleration data concerning the rotor 104. Because the pedals 102 are connected to the rotor 104 by chain 103, the velocity detected by encoder 105 corresponds to the pedal velocity 102.

Pedal rate 106 from encoder 105 is multiplied times gear rollout 107 at diagram element 108. As described in more detail below, the virtual bike velocity 110 is calculated utilizing the virtual friction, aerodynamic and other losses, along with the effects of rider weight, gravity, hill angle, and other factors. As also described in more detail below, the estimated total rider power (watts) is also utilized in calculating the virtual velocity 110.

The difference between the virtual velocity 110 and the measure velocity 109 is taken at the diagram element 111, and the velocity difference 112 is utilized as an input to the game transfer function 113 to provide a control signal or value 114. The value 114 is divided by the gear roll out 107 at diagram element 115, and the resulting output (watts) 116 is added to the rider total watts 117 at diagram element 118. The output 119 is supplied to the alternator gain transfer function 120. The alternator gain transfer function 120 is utilized to generate a pulse with modulation (PWM) signal 121 to control the alternator.

The load 122 and power (watts) 123 from the alternator is utilized as an input 124 to the total power estimation 125. Each of the losses in the actual stationary bike system are also supplied to the total power estimation 125. These losses include the bike frictional loss 126, the alternator windage and any current loss 127, the circuit power losses 128, and the losses 129 due to battery charging. The total power estimation 125 provides the total rider wattage 117 to the other portions of the control system.

As shown at diagram element 130, the total rider watts are divided by the virtual velocity 110 to provide rider estimated forces 131. The estimated rider forces 131 are summed with the virtual friction loss 132, virtual aerodynamic loss 133, and the hill forces 134 to provide a total rider force 136. The frictional loss 132 may be calculated utilizing the virtually velocity 110 according to a variety of suitable methods. Similarly, the aerodynamic loss 133 is determined utilizing the virtual velocity squared 137. The hill forces 134 are determined by multiplying the slope or hill angle 138 by the weight 139 of the rider and bike as shown at diagram element 140. The rider and virtual bike weights are added together at 141 to provide a weight 142. The total rider force 136 is divided by the bike and rider weight 142 as shown at diagram element 143 to determine the virtual rider acceleration 144. The virtual rider acceleration 144 is integrated by an integrator 145, and the output 146 of integrator 145 is the virtual bike velocity 110.

With further reference to FIG. 2, a diagram 150 of a control system according to another aspect of the invention is somewhat similar to the control system of FIG. 1A, and the corresponding features are therefore numbered the same as in the diagram of FIG. 1A. The primary difference between the control system of FIG. 2 and the control system of FIG. 1A, is the utilization of measured pedal force 160 as an input into the calculation of total true forces 80 as illustrated at diagram element 79. As described above, the system of FIG. 1A utilizes total rider true watts 54 (FIG. 1A) divided by measured velocity 71 to determine an estimated force 56. In contrast, the system of FIG. 2 utilizes the actual measured forces 160. The other aspects of the control system of FIG. 2 are substantially similar to the corresponding elements described in detail above in connection with FIG. 1A, such that these elements will not be further described in detail.

Figure 3:
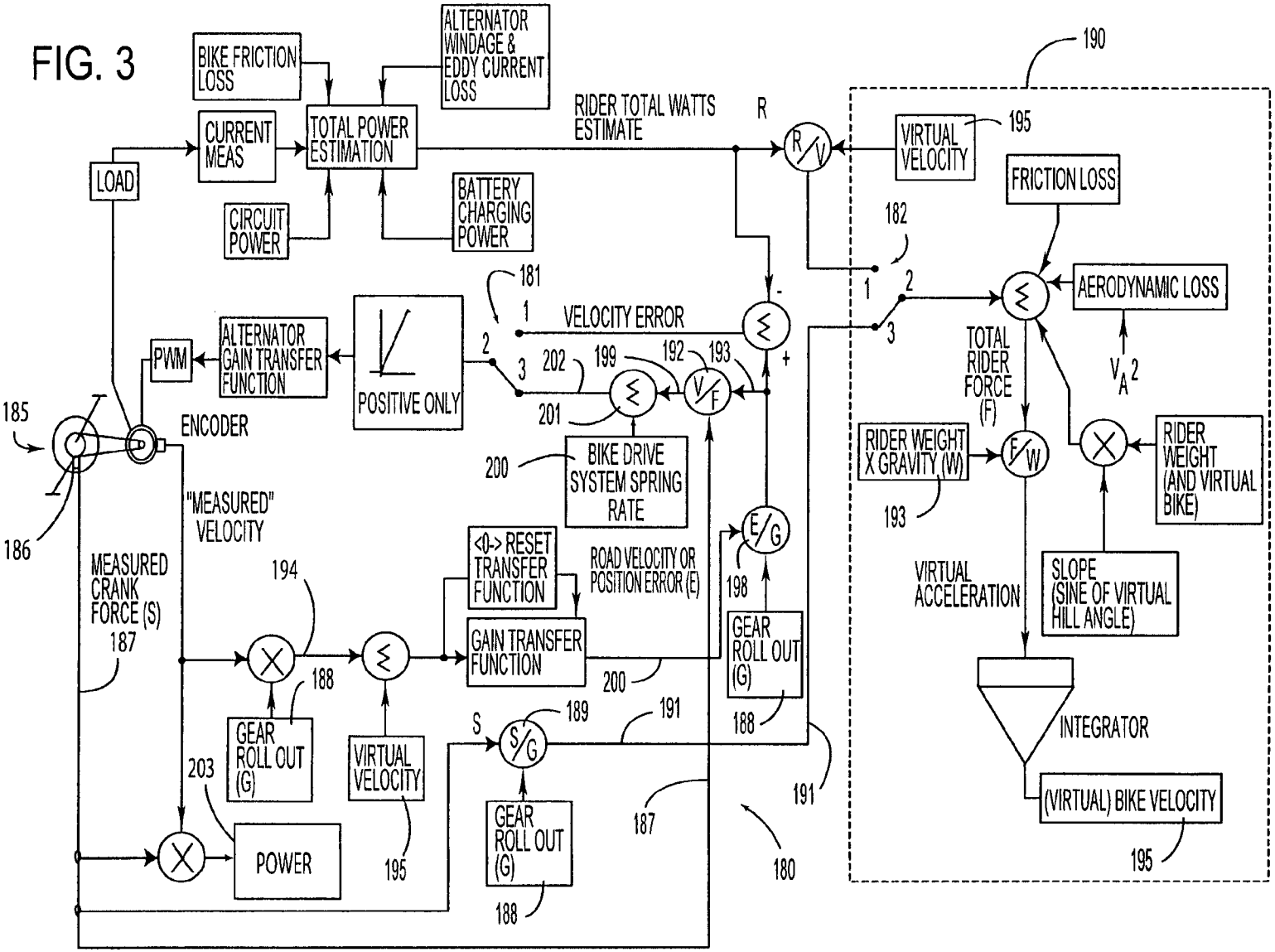
FIG. 3 is a schematic diagram of a control system and exercise apparatus according to another aspect of the present invention.

With further reference to FIG. 3, a control system 180 according to another aspect of the present invention includes a first switch 181 and a second switch 182. When the switch is in the upper position (i.e., connecting nodes I and II), and the second switch 182 is also in the upper position (i.e., interconnecting nodes I and II of switch 182), control system 180 operates in substantially the same manner as the control systems described in detail above in connection with FIGS. 1A, 1B, and 2. However, when switches 181 and 182 are in the second position (i.e., nodes II and III of switches 181 and 182 are connected), control system 180 operates in a different mode, and utilizes a force sensor to provide a force 187 to control the bike 185. When the control system 180 is in the second mode utilizing force input 187, the force input 187 ("S") is divided by gear rollout 188 ("G") at diagram element 189, and the resulting measured force 191 is supplied to a bike road model 190 through switch 182 instead of the estimated rider forces utilized in the control systems of FIGS. 1A, 1B, and 2. The bike road model 190 is substantially the same as the corresponding components of the control systems shown in FIGS. 1A, 1B, and 2 above. In contrast to the control systems described above, control system 180 utilizes the measured force 187 as a control input rather than an estimated force calculated from the user's estimated power input. As shown at diagram element 192, the velocity difference 193 between the measured velocity 194 and the virtual velocity 195 is divided by the measured force input 187 ("S") at diagram element 192. The result 199 is added to a spring rate 200 at diagram element 201 to provide a value 202 that is utilized by the alternator gain transfer function to control the alternator. The spring rate 200 represents the stiffness of the entire stationary bike system.

The control system 180 generates a signal to the alternator to generate a force that is proportional to the displacement in the stationary bike. Thus, if the controller "senses" that a large bike frame deflection is present, the controller generates a signal to the alternator to generate a correspondingly large resistance force that is, in turn, felt by the rider. The control system 180 is capable of providing a very accurate model of an actual bike. Also, because the control system 180 utilizes actual forces, the controller 180 automatically compensates for variations in forces generated by friction and the like in the stationary bike. Thus, if the forces resulting from friction, for example, vary as the stationary bike gets older due to bearing wear or the like, the control system 180 will still provide an accurate force feedback to the rider. Also, the control system 180 similarly provides accurate force feedback regardless of whether or not various stationary bikes in production have different frictional characteristics due to manufacturing tolerances and the like. Still further, the control system 180 also compensates for variations that would otherwise occur due to the operating conditions of the stationary bike.

The control system 180 may also provide an accurate display of the power input by the user. The product of the measured crank speed and the measured crank force is the true rider power 203. The true rider power 203 may be displayed on display unit 50 (FIG. 11) utilizing a suitable visual representation.

Figure 4:
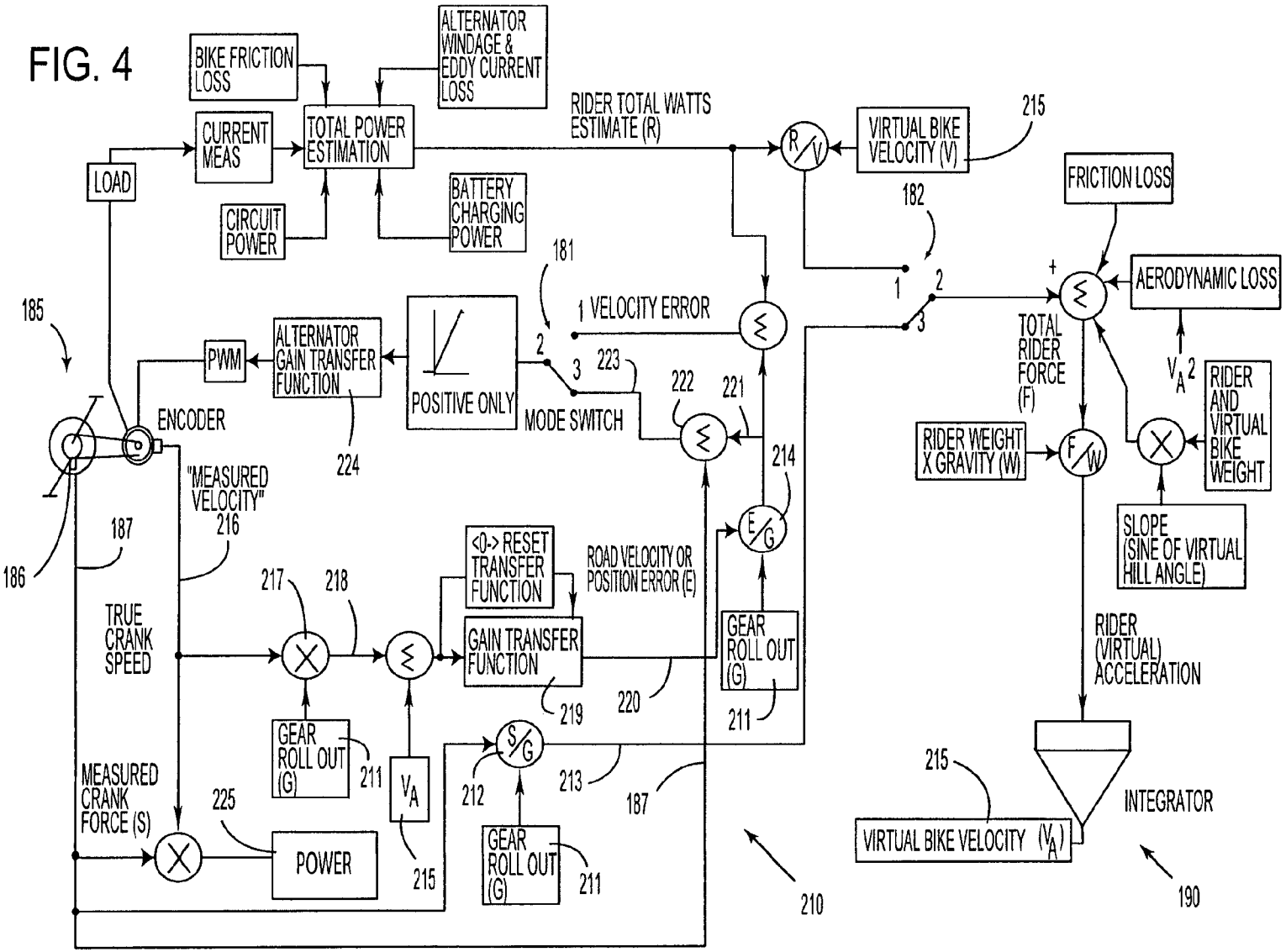
FIG. 4 is a schematic diagram of a control system and exercise apparatus according to another aspect of the present invention.

Yet another control diagram or system 210 is illustrated in FIG. 4. The control system 210 is somewhat similar to the control system 180, and includes a force sensor 186 providing a measured force 187. Switches 181 and 182 provide for switching modes between an estimated power mode that is similar to the arrangements described in detail above in connection with FIGS. 1A, 1B, and 2, and a force measurement mode. In the force measurement mode, the force 187 is divided by the gear rollout 211 at diagram element 212 to provide a measured force 213 that is utilized as an input in bike road model 190 in substantially the same manner as described above in connection with FIG. 3. The measured crank velocity 216 is multiplied times gear rollout 211 at diagram element 217, and the difference between the resulting measured bike velocity 218 and the virtual velocity 215 from the bike road model 190 is input to gain transfer function 219. The gain transfer function 219 provides a velocity difference or error 220 ("E") which is divided by gear rollout 211 ("G") at diagram element 214 to provide a crank velocity or position error 221. The difference between the position error 221 and the measured force 187 is taken at diagram element 222, and the resulting value 223 is used by the alternator gain function 224 to generate a signal controlling the alternator and corresponding resistance force experienced by a user. Control system 210 also provides for true rider power 225 by taking the product of the measured crank velocity 216 and the measured crank force 187. The true rider power 225 may be shown on display 50 or other suitable device.

Figure 5:
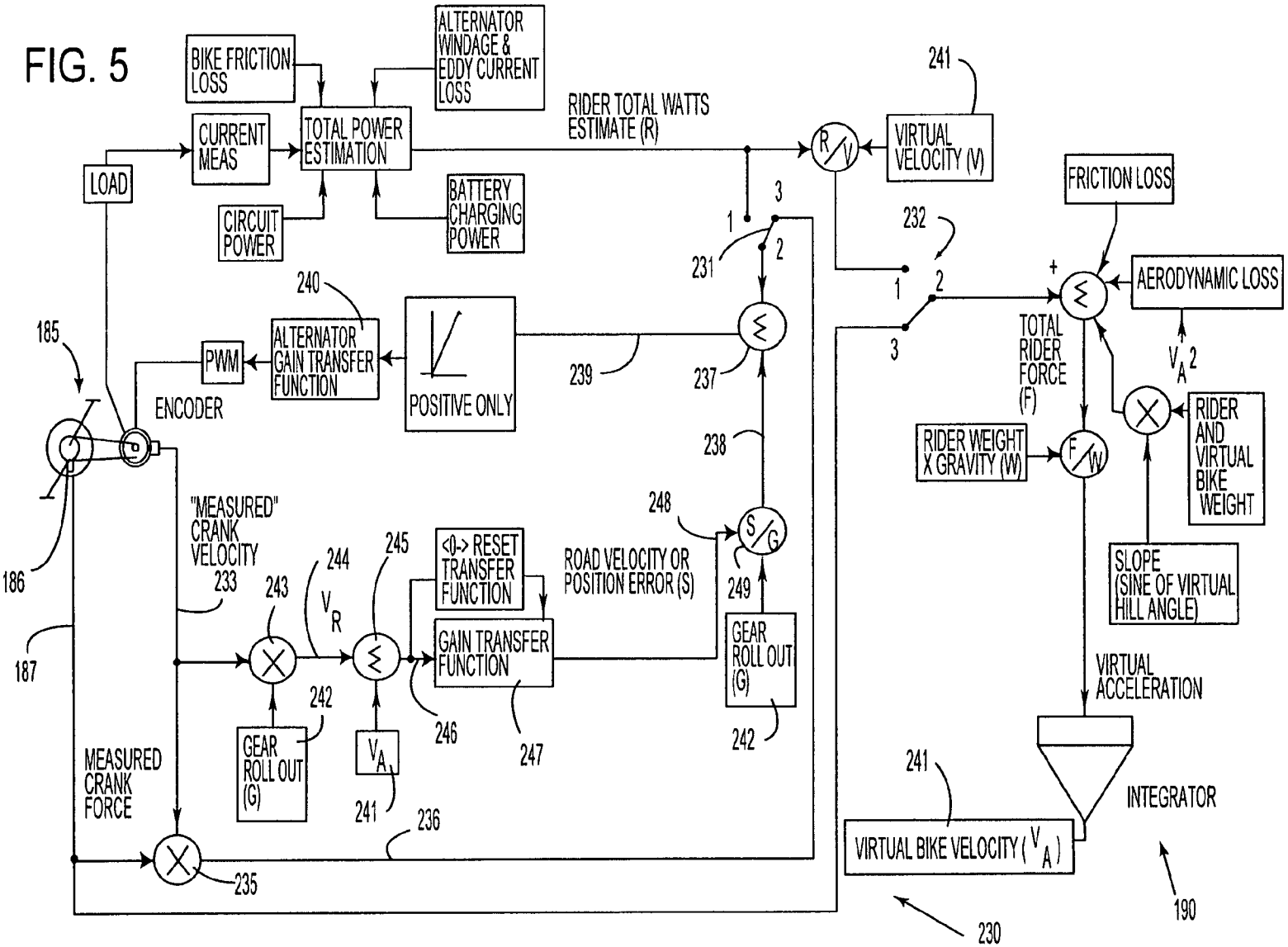
FIG. 5 is a schematic diagram of a control system and exercise apparatus according to another aspect of the present invention.

A control system 230 according to yet another aspect of the present invention is illustrated in FIG. 5. Control system 230 includes first and second switches that enable the controller 230 to be changed between an estimated rider force mode similar to the control method/scheme of FIGS. 1A, 1B and 2, and a force measurement mode that is somewhat similar to the control arrangement discussed above in connection with FIGS. 3 and 4. The controller 230 utilizes the product of the measured velocity 233 and the measured force 234 as shown at diagram element 235 to produce "true" (measured) rider power 236. When the control system 230 is in the measured force mode, the true rider power 236 is added to the velocity or position difference or error 238 at element 237, and the resulting value 239 is utilized by the alternator gain transfer function 240 to control the alternator or other force-generating device. In the control scheme 230, the measured velocity 233 is multiplied by gear rollout at 243, and the resulting measured velocity 244 is added to the virtual velocity 241 at 245. The resulting velocity 246 is then provided to gain transfer function 47, and the resulting velocity difference or error 248 is divided by gear rollout 242 at 249 to, in turn, generate the velocity or position difference 238.

Figure 6:
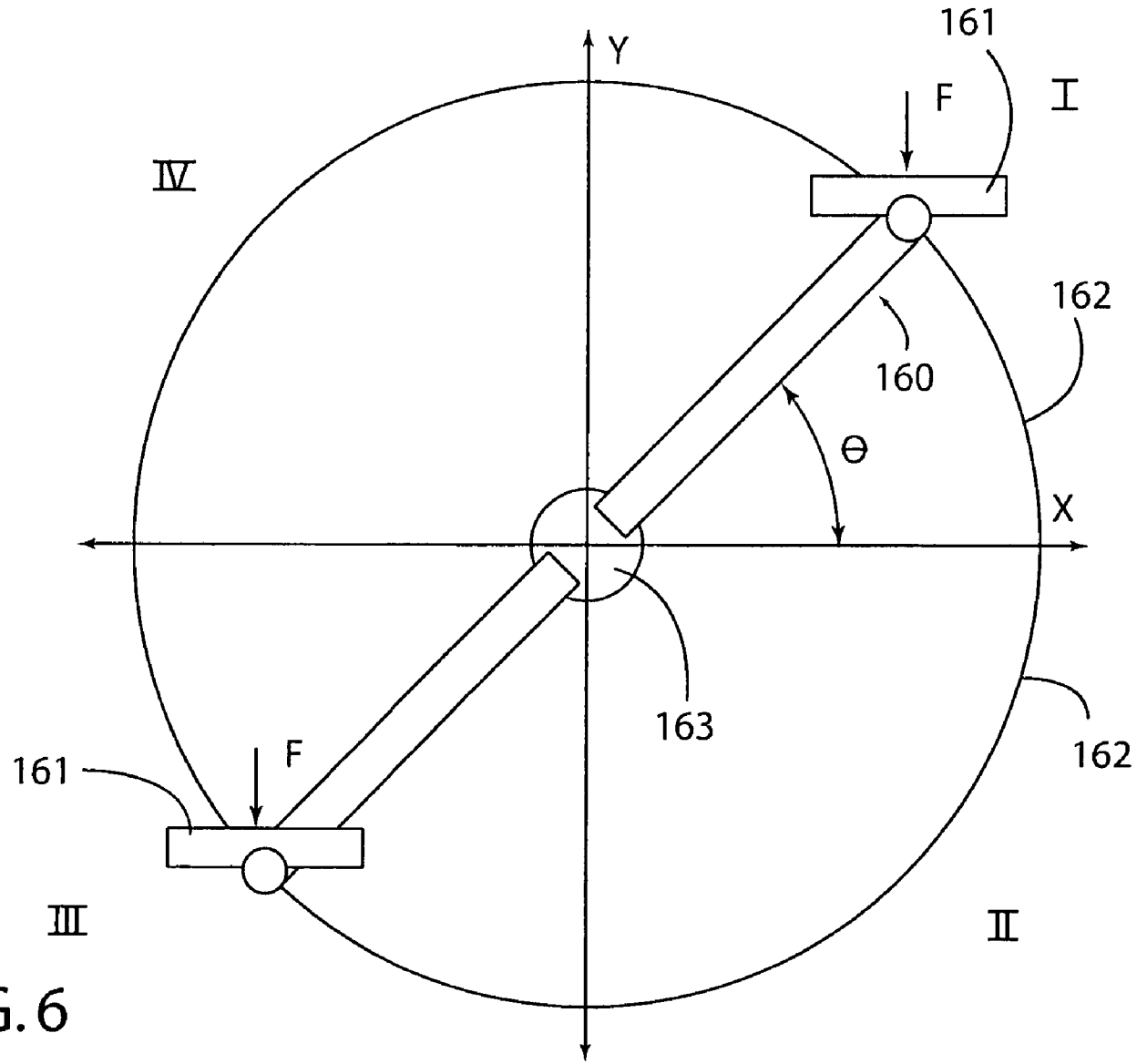
FIG. 6 is a schematic view of a crank and pedals of a stationary bike or a movable bike.
Figure 7:
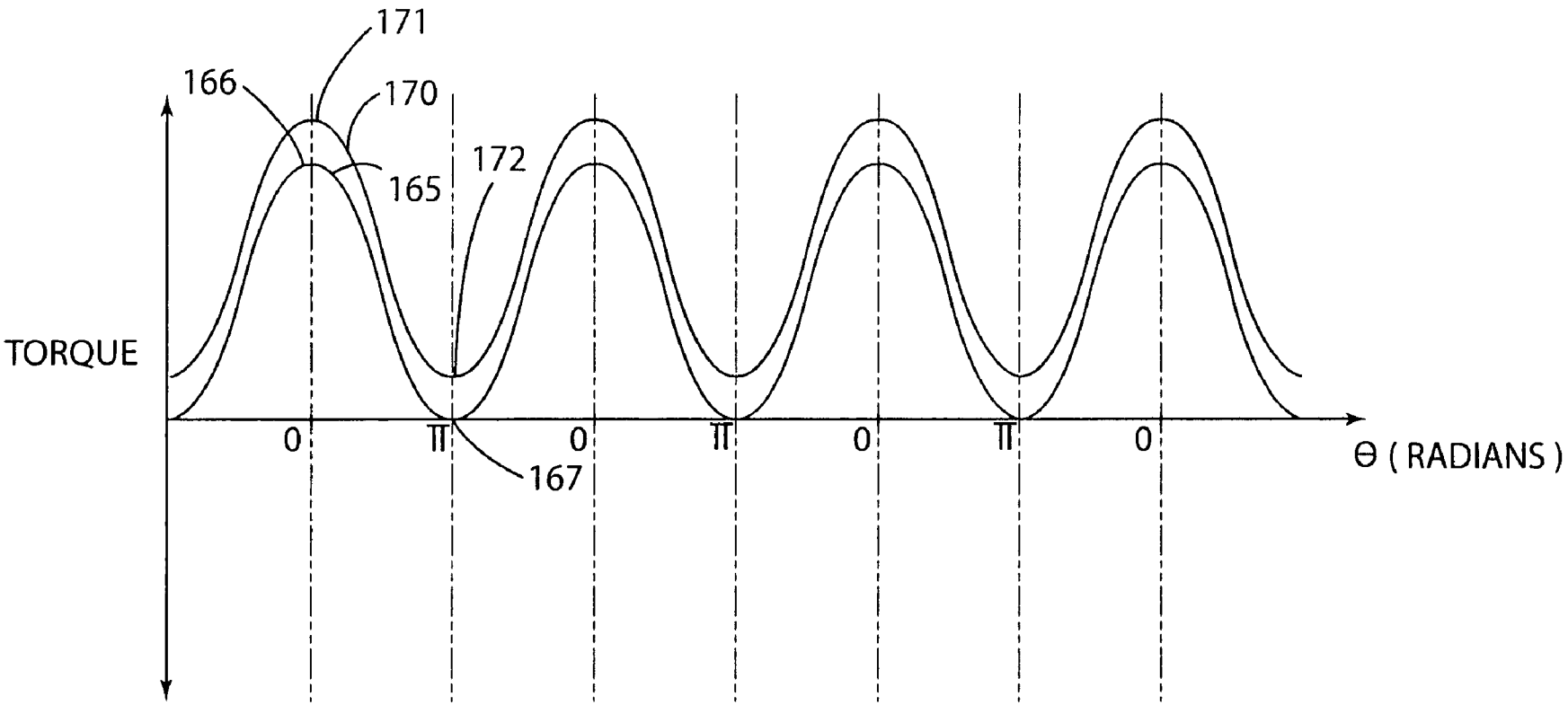
FIG. 7 is a graph showing force (torque) variations produced and experienced by a user as a function of crank angle.

With reference to FIG. 6, a bike crank 160 includes pedals 161 that rotate about axis 163 in a circular path 162. When a rider is riding on a real bike, the rider will generally tend to generate a higher force on a pedal 161 as the individual pedal 161 travels through the first quadrant I and second quadrant II adjacent the X axis. As each pedal 161 rotates around the circular path 162, the force generated by a rider will tend to be close to zero at 90° and negative 90° (top and bottom). Also, the force tends to be lower in quadrants III and IV than in quadrants I and II. In general, the force generated on an individual pedal 161 will vary periodically. The total torque generated by the rider is the sum of the forces applied to each pedal at each instant. Although the total torque generated by a user will tend to vary somewhat from one pedal revolution to the next, the total torque for most riders will be in the form of a periodic curve 165 as shown in FIG. 7. Although the exact shape of curve 165 will vary from rider to rider, and also will vary somewhat from one revolution of the crank 160 to another, and also under different riding conditions (slope, wind, riding surface, etc.) the curve 165 tends to have a shape that is similar to a sine wave. The graph of FIG. 7 illustrates the total torque generated on a crank by both pedals 161 as a function of the crank angle θ where the angle is in radians. In general, a force peak 166 in FIG. 7 will occur each time one of the pedals is at or near the X axis (FIG. 6) and the crank angle θ is zero or 180°. As the crank 160 rotates, the force generated by a rider falls off until it reaches a low point 167 that generally occurs when the pedals 161 are directly above and below the axis 163.

Due to the physics involved in riding an actual bike, the force exerted by the rider on an actual bike is equal to the resistance force felt by the rider from the pedals 161 due to the affects of acceleration, aerodynamic drag, friction, rolling resistance, hill angle, and the like. Thus, for a real (non-stationary) bike, the force both the rider input, and the resistance force experienced by the rider may take the form of curve 165. It will be appreciated that the present control system provides a force variation that varies periodically in substantially the same manner as a real bike, such that the force curve 165 is substantially duplicated by the control system of the present invention. In this way, the control system of the present invention provides a much more accurate simulation of the actual forces experienced by a rider.

Also, it will be understood that different riders may have different force curves. For example, a highly-trained experienced rider may produce a force curve 170. The force curve 170 includes a peak 171 at substantially the same crank angle as peak 166, and also includes a low force point 172 that occurs at the same crank angle θ as the low force point 167. However, because an experienced rider can generate force on the pedals throughout the pedal's range of movement, the low force point 172 may be a positive number that is above the zero force axis.

Although the forces are illustrated as having the shape of a sine wave in FIG. 7, it will be understood that the actual applied and resistance forces may not have the exact shape of a sine wave. Nevertheless, in steady-state cycling, most riders will tend to apply a periodic force to the pedals that is similar to a sine wave, and the resistance force is also generally a periodic function similar to a sine wave. Significantly, the controller of the present application provides a resistance force that is substantially the same as the periodic forces illustrated in FIG. 7. As discussed in detail above, the control system of the present application generates a force based, at least in part, upon the virtual acceleration. Because the control system and apparatus of the present invention provides for the various dynamic and other factors associated with riding a real bike, the force experienced by a rider is substantially the same as those experienced by a rider on a real bike.

Figure 12:
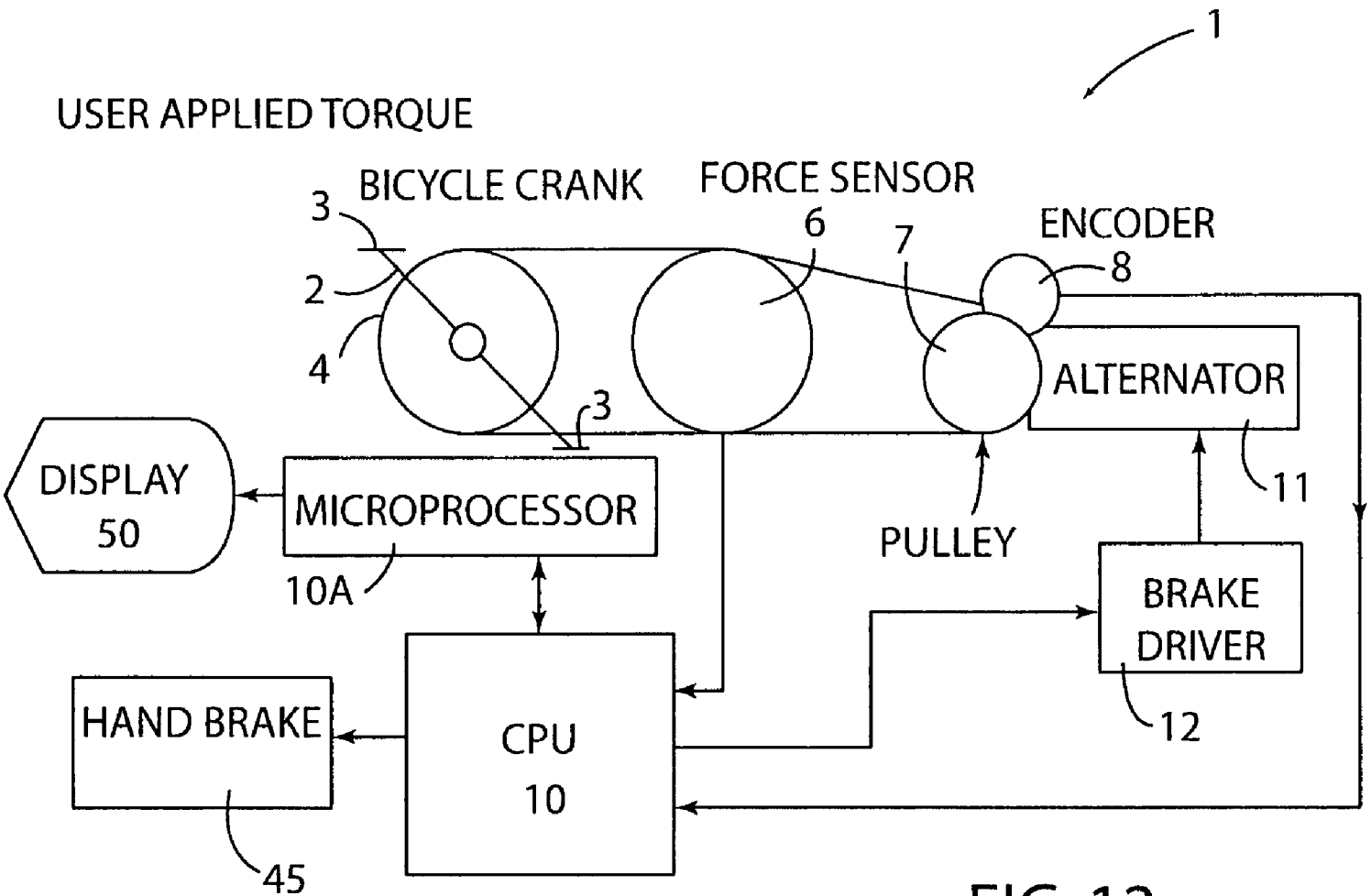
FIG. 12 is a schematic diagram of a stationary bike and control system according to one aspect of the present invention in which a forced sensor is utilized in the control system.

FIG. 12 is a schematic drawing of a stationary bike 1 including a force sensor 6 according to another aspect of the present invention. The stationary bike 1 includes a crank 2 with pedals 3 and a drive member 4 such as a pulley, toothed cog or the like. The drive member 4 engages a flexible drive member 5. The flexible drive member 5 may be a toothed belt, chain, or the like. A rotary inline force sensor 6 engages the flexible drive member 5, and measures the tension in the flexible drive member 5. Although force sensor 6 is preferably a rotary inline type sensor, numerous other force sensing devices could be utilized. For example, a force sensor could be configured to measure the force applied to the alternator. The force sensor could be positioned between the alternator and the support structure holding the alternator. Alternately, a force sensor could be configured to measure the force acting on the crank arms, or on the pedals. A belt tension monitoring device or the like could also be utilized. A force sensor could also be mounted to the alternator pulley with a slip ring set-up. Still further, if the degree of movement of a particular structure as a function of applied force is known, the deflection may be measured and utilized to calculate the applied force.

Rotary inline force sensor 6 is operably coupled to a Central Processing Unit ("CPU") 10, and provides force data to the CPU 10. The flexible drive member 5 engages a driven member 7 that is operably coupled to an encoder 8. The encoder 8 is configured to determine the position and/or velocity of the flexible drive member 5, so the rotational rate (angular velocity) of crank 2 can be determined. The encoder 8 is operably connected to the CPU 10, and thereby provides velocity and/or position data to the CPU 10. An alternator 11 is operably coupled to the driven member 7 to thereby provide an adjustable resistance force based upon input from the brake driver 12. The brake driver 12 is operably coupled to the CPU 10 to provide force control. Microprocessor 10A is operably coupled to display 50 to provide visual information (see also FIG. 11) to the user concerning the bike's virtual speed, the power generated by the user, pedal r.p.m., virtual hill angle, and the like. Also, as described in more detail below, a hand brake 45 is operably coupled to CPU 10 to provide a braking force feedback that may be utilized in control of the bike 1.

Figure 2A:
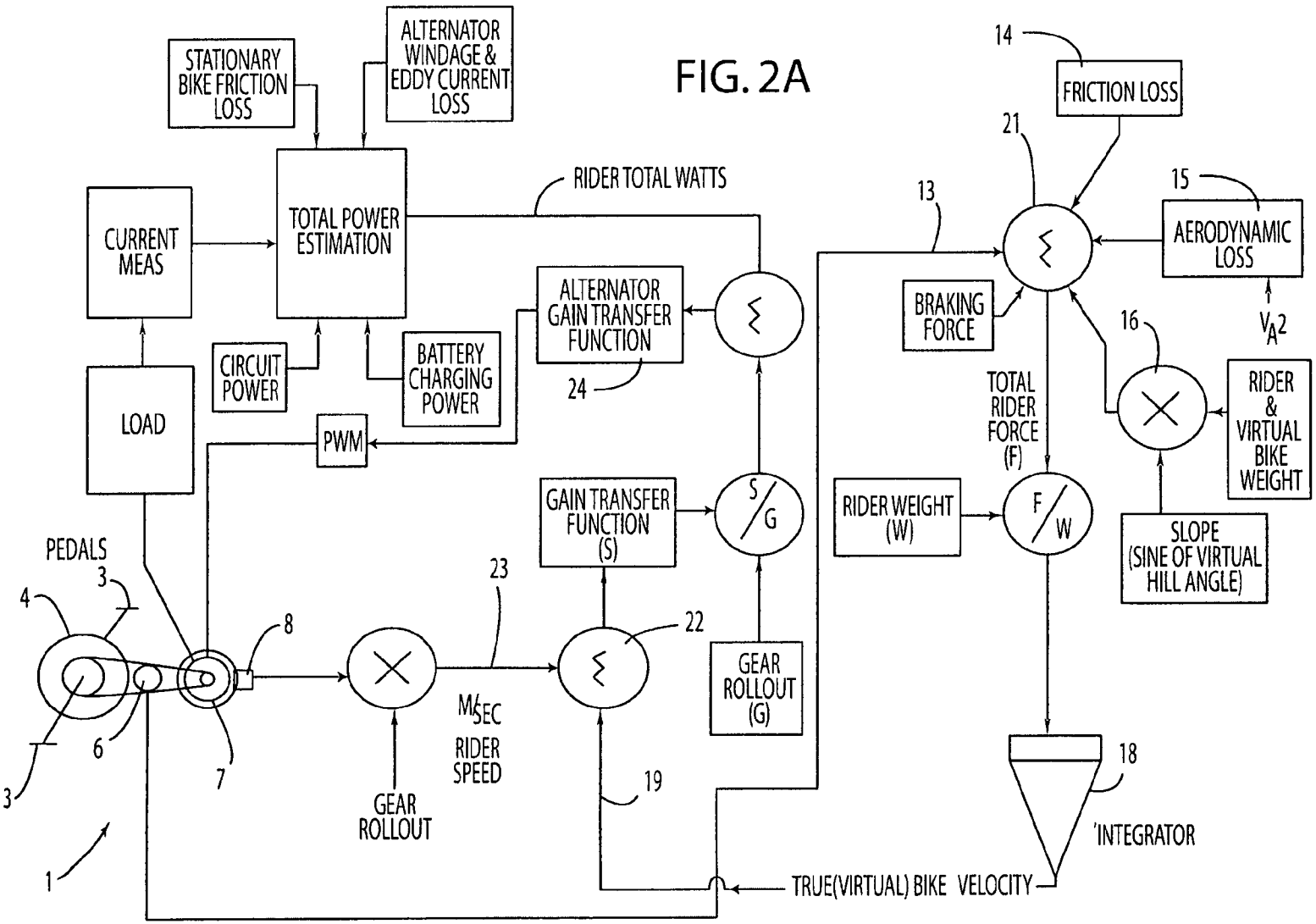
FIG. 2A is a schematic diagram of a control system and apparatus according to another aspect of the present invention utilizing a measured force.

With reference to FIG. 2A, a control system arrangement for a bike 1 according to another aspect of the present invention (FIG. 12) utilizes the measured force from force sensor 6 instead of the estimated force as illustrated in FIGS. 1A and 1B. In the system of FIG. 2A, the force measured by the force sensor 6 is input into the summation 21 and added to the friction loss 14 and windage/aerodynamic drag loss 15, braking force (optional) and the force 16 due to gravitational forces and the slope of the virtual hill to calculate the total force F. The acceleration is then calculated by dividing force F by the rider mass, and the acceleration is then integrated in the integrator 18 to provide the velocity. The true bike velocity 19 from the integrator goes into a summation 22 along with the measured velocity 23. The difference between the measured velocity 23 and the true bike velocity 19 is then multiplied by a large gain transfer function 24 as discussed above. Thus, although the principle of operation of the system illustrated in FIG. 2A is substantially similar to the system of FIG. 1B, the use of measured force rather than estimated force provides for a potentially more accurate simulation. FIG. 2 shows another control system that utilizes measured force at the pedals rather than a force estimate.

The control systems may optionally include a brake feature to simulate the effects of braking. With reference to FIG. 2A, a braking force may also be added to the other forces at summation 21 to thereby reduce the calculated bike velocity. A braking force may also be added to total true forces shown in FIGS. 1A and 1B. Braking may be utilized when the bike simulator is part of a full rider experience, like a computer game, where riders might ride together, jockey for position, go around curves, draft each other and the like. In this example, the brake may be used to prevent collisions or falling in the simulation. A simulation of this type may include a display of the rider's position and the environment of the ride.

With reference to FIG. 19, a brake lever 40 may be rotatably mounted to a handle 41 of a stationary bike. Handle 40 is biased away from a "brake engaged" position shown as line "B" in FIG. 12 towards a disengaged position shown as line "A" (FIG. 19). As a rider rotates handle 40 from disengaged position A through angle θ1 to the brake engaged position B, a relatively small torque T1 is generated due to a rotary spring (not shown) or the like. However, once the handle 40 reaches engaged position B, the handle 40 hits a very stiff spring or a rigid stop to thereby provide a tactile feel to a rider that is substantially similar to a real bicycle having caliper type brakes. The force (torque) T2 acting on handle 40 in engaged position B can be measured and utilized as feedback (i.e., input) into the control systems of FIGS. 1A, 1B, and 2A. Alternately, if a stiff spring (not shown) is used instead of a stop at position B, the movement of handle 40 can be multiplied times the spring constant to provide a brake force for the control system. An electrical or optical line 42 may be utilized to operably connect the force (or displacement) sensor to the controller 10 of FIGS. 12 and 13.

The controller may utilize the measured (applied) force on the brake in a variety of ways to control the resistance force. For example, the function describing the velocity lost from the virtual bike velocity may be a linear equation, a polynomial, or an exponential function of the force applied to brake lever 40. Alternately, the velocity (power) loss may be estimated from empirical data utilizing a look up table or a curve-fit such as a spline.

Figure 13:
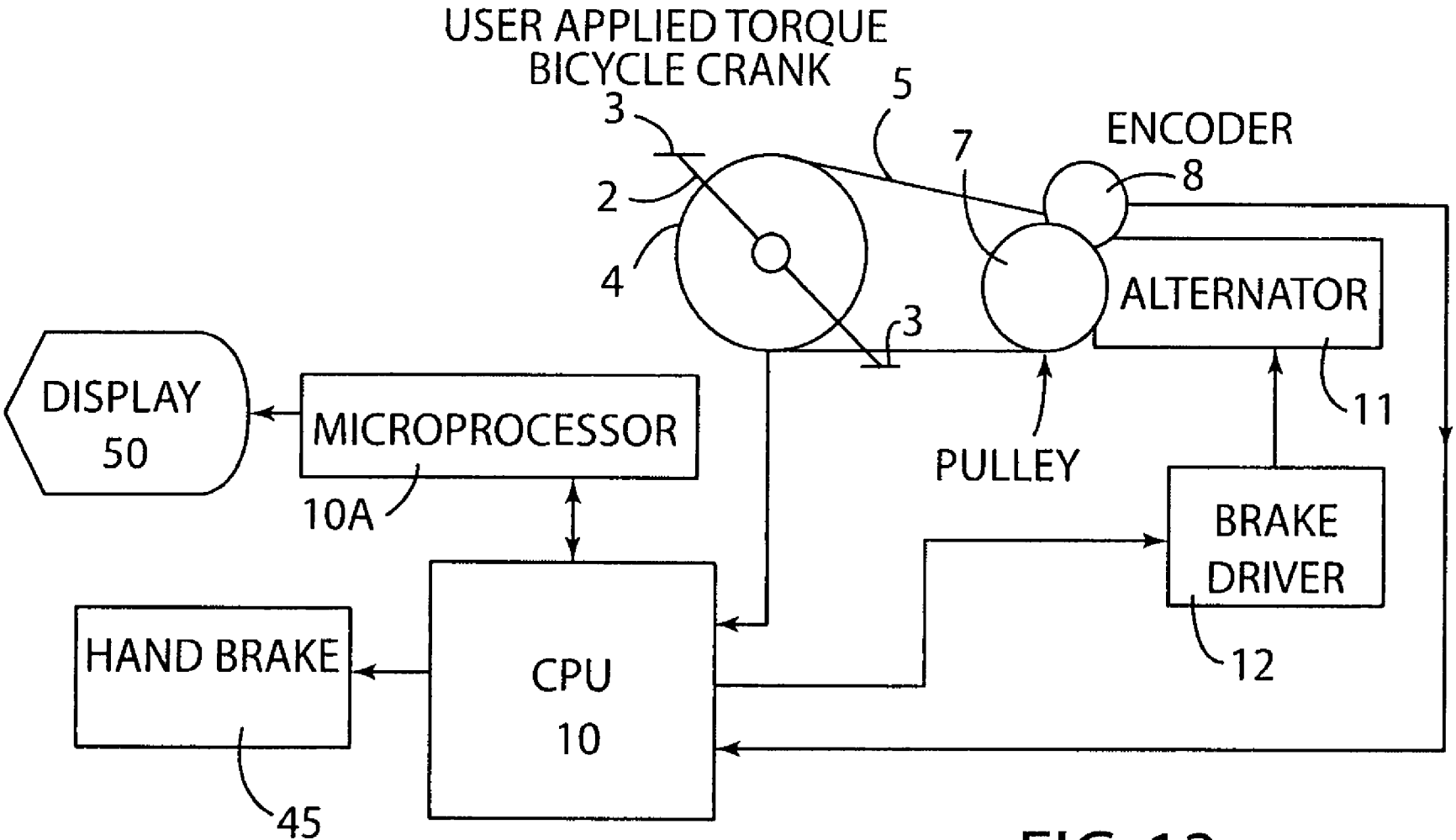
FIG. 13 is a schematic diagram of an exercise bike according to another aspect of the present invention in which the bike does not include a force sensor.

With further reference to FIG. 13, a stationary bike 20 according to another aspect of the present invention is similar to the stationary bike 1 of FIG. 12, except that stationary bike 20 does not include a force sensor 6. Stationary bike 20 includes a crank 2, pedals 3, drive member 4, flexible drive member 5, driven member 7, encoder 8, processor 10, alternator 11, hand brake 45, display 50 and brake driver 12. These components are substantially the same as described above in connection with stationary bike 1 (FIG. 12). However, because stationary bike 20 does not include a force sensor, control of bike 20 may be implemented via a power-based force estimation arrangement as illustrated in FIGS. 1*a* and 1B.

As discussed in detail in U.S. Pat. No. 6,454,679 (previously incorporated herein by reference), a basic equation of motion can be expressed as:

$$V(\text{update})=V+[(F_a-F_d)-m_1{}^*g\sin\theta](t_{inc}/m_1{}^*) \tag{1.1}$$

With further reference to FIG. 14, for a bicycle simulation, this equation becomes:

$$V(\text{update})=V+[(F_a-F_d)-(m_1+m_2)g\sin\theta-0.5\,C_1\rho QV^2](t_{inc}/(m_1+m_2)) \tag{1.2}$$

The input variables for the bike equation are illustrated in FIG. 14.

Figure 15:
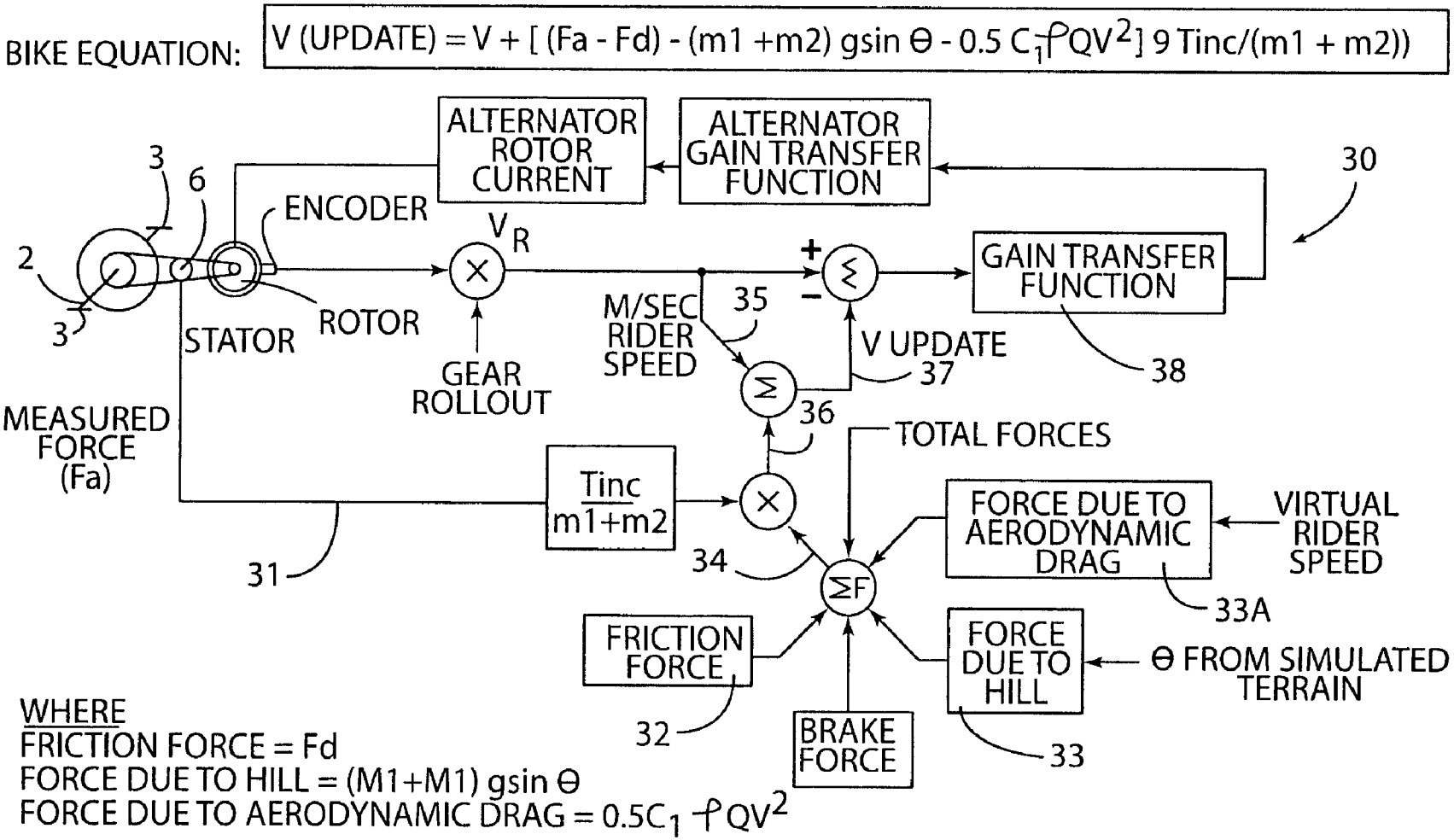
FIG. 15 is a schematic diagram showing a control system according to another aspect of the present invention.

With further reference to FIG. 15, a stationary bike system 30 utilizing the bike equation (1.2) utilizes the difference between the update velocity (V(update)) and the measured velocity V multiplied times a large gain (i.e., numerical value) to determine the amount of force to be generated by the alternator. A force 31 from force sensor 6 is added to the friction force 32, the force due to the hill 33, and the force due to aerodynamic drag 33A at summation 21 to provide a total force 34. The drag force $F_d$ is given in FIG. 14, and the force due to a virtual "hill" is given by:

$$F_{hill}=(m_1+m_2)g\sin\theta;\ \text{where } \theta=\text{the slope angle of virtual hill} \tag{1.3}$$

The force due to aerodynamic drag is given by:

$$F_{aero}=-0.5C_1\rho QV^2 \tag{1.4}$$

It will be understood that the coefficient of drag C1 may be adjusted to account for the differences between individual users. Also, the control system may adjust the coefficient of drag C1 based upon whether or not a user's hands are grasping the tops 27A (FIG. 1) or drops 27B of handlebar 27. This may be done based upon a signal from sensors on the handlebars. Alternately, the bike 1 may include a user input feature that permits a user to select either a "tops" riding configuration or a "drops" riding configuration. The controller may have stored information concerning coefficients of drag for the two riding positions, and thereby adjust the aerodynamic drag factor accordingly. Or the controller may contain information that will allow it to calculate aerodynamic drag coefficients based on user mass, and or height and or other bodily dimension.

Also, the controller may be programmed to provide coefficients of drag that simulate aerodynamic drag associated with different types of bikes. For example, the controller may have stored coefficients of drag for mountain bikes and for road bikes or recumbent bikes. Still further the controller may include a feature that permits it to calculate or otherwise determine the coefficient of drag for a particular user based on the user's weight, height, or the like. In this way, the controller can simulate the effects of aerodynamic drag for different size riders, different rider handlebar positions, and different bike styles/configurations. The total forces 34 are divided by $T_{inc}/(m_1+m_2)$, and this quantity 36 is added to the measured rider velocity V to give V(update) 37. The difference between the velocity V and V(update) is multiplied by a relatively large number (gain) to provide the feedback for the amount of braking force generated by the alternator.

Alternately, equation (1.2) can be expressed as:

$$\Delta V=V(\text{update})-V=V+[(F_a-F_d)-(m_1+m_2)g\sin\theta-0.5\,C_1\rho QV^2]/(t_{inc}/(m_1+m_2))$$

Figure 16:
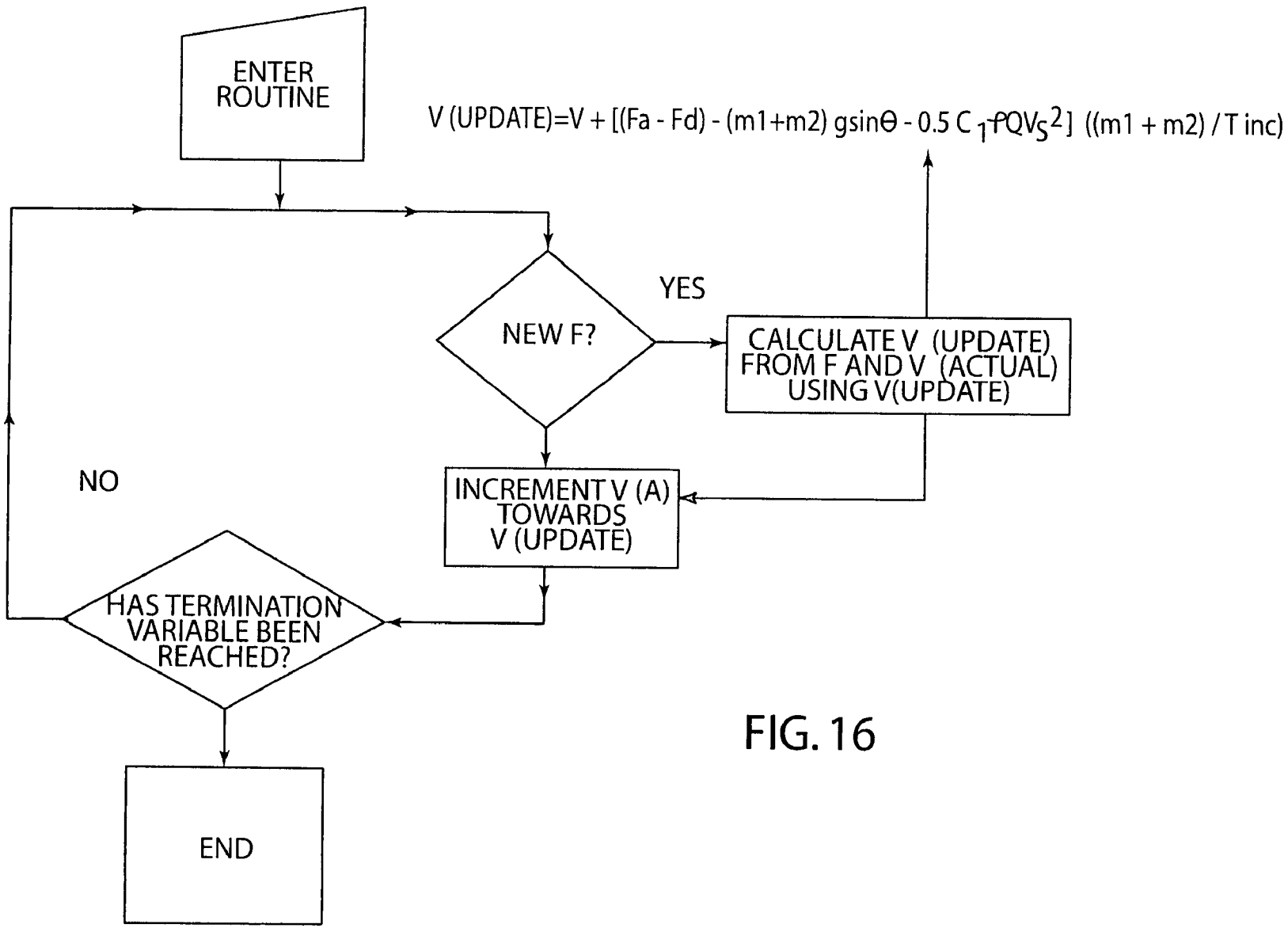
FIG. 16 is a diagram showing a haptic routine implementing the equation of FIG. 8.
Figure 17:
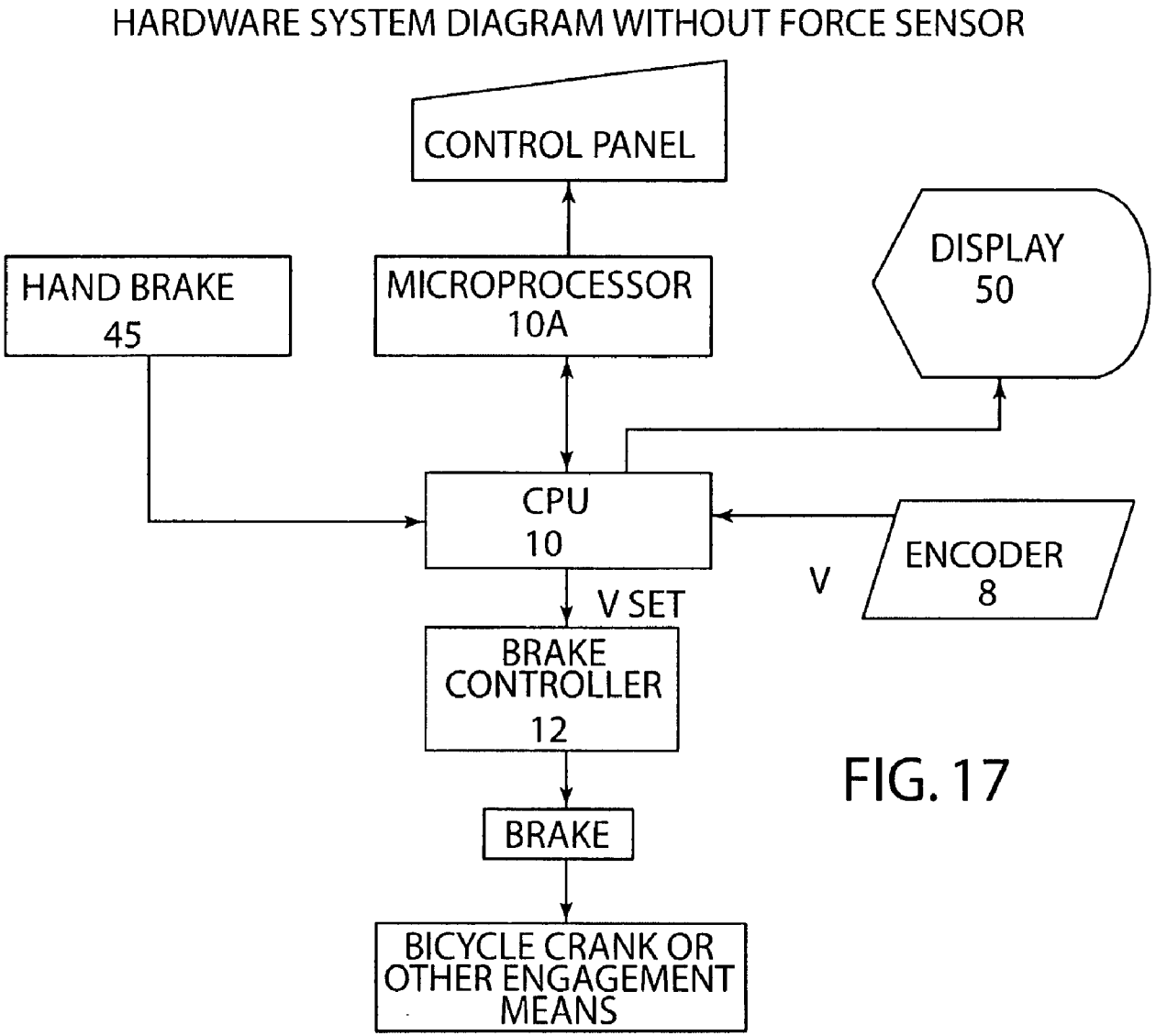
FIG. 17 is a diagram showing a control system that does not utilize a force sensor according to another aspect of the present invention.
Figure 18:
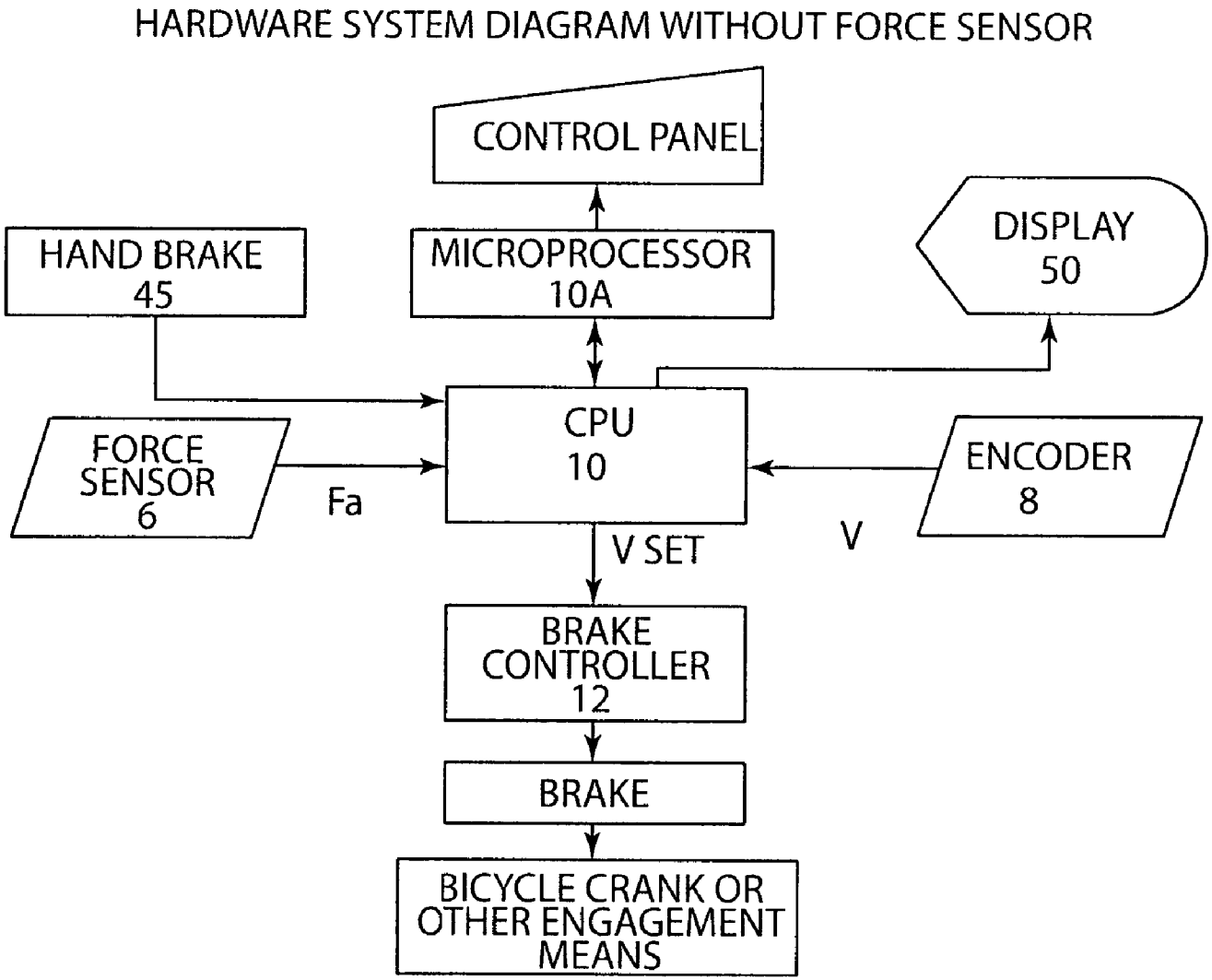
FIG. 18 is a diagram of a control system utilizing a force sensor according to another aspect of the present invention.

In this way, the difference ΔV between the measured velocity V and V(update) can be directly calculated and multiplied by a large gain to provide feedback control. Thus, the quantity 36 in FIG. 15 can be directly input to the gain transfer function 38 to provide feedback to the alternator to control the force generated by the alternator. The haptic routine for implementing the system of FIG. 15 is illustrated in FIG. 16, and a block diagram illustrating the system of FIG. 15 is shown in FIG. 17.

As discussed above, the drag force $F_d$ for a bicycle can be calculated utilizing the equation of FIG. 14. Also, the force a rider experiences due to a hill is:

$$F_{hill}=(m_1+m_2)g\sin\theta \tag{1.3}$$

and the aerodynamic drag can be calculated as:

$$F_{aero}=-0.5C_1\rho QV^2 \tag{1.4}$$

Each of the forces $F_d$, $F_{hill}$ and $F_{aero}$ are functions of velocity or the slope of the virtual hill. The other forces acting on the rider are the result of the angular and linear acceleration of the rider/bike and the moment of inertia and mass of the rider/bike.

Accordingly, a stationary bike according to another aspect of the present invention may include a flywheel having an adjustable moment of inertia. The flywheel may be operably coupled to a controller, such that the rider's weight can be input, and the flywheel can be adjusted to provide an inertia that is the equivalent of an actual rider on a bicycle. In other words, the inertia of the flywheel can be adjusted to provide the same amount of acceleration for a given force on the pedals as a rider would experience on a "real" bicycle. The friction force Fd (including rolling resistance), the force due to the virtual hill (Fhill), and the forces due to the aerodynamic drag (Faero) can be calculated based on velocity and hill angle (and rider/bike mass) and input into the processor and utilized to adjust the resistance force generated by the alternator or friction brake. In this way, the adjustable inertia flywheel can be utilized to model the forces due to acceleration, and the velocity measured by the encoder and the hill angle from the simulation can be utilized to provide additional forces simulating the effects of rolling friction, hills, and aerodynamic drag.

A stationary bike according to yet another aspect of the present invention utilizes measured acceleration rather than measured force as an input to the control system. In general, force is equal to mass times acceleration. Thus, rather than measuring force directly as described above, the acceleration can be measured (or calculated as the derivative of velocity, which, in turn, is the derivative of position) and multiplied times the effective mass of the system to thereby obtain "measured" force. This "measured" force may be utilized in substantially the same manner as described above in connection with the direct force measurement aspects of the present invention.

Still further, the position of the bike pedals may also be measured, and the difference between the measured position may be utilized as a control input. For example, a virtual velocity calculated according to the control systems described above may be integrated to provide a virtual position. The difference between this virtual position and a measured position may then be utilized as the control input rather than a velocity difference. It will be appreciated that the gain/transfer function may be somewhat different if a position difference is utilized as a control input.

Alternator Control (FIGS. 20-25)

Use of an alternator in exercise equipment to absorb the energy generated by the exercising person is known. The advantages of using an alternator in exercise equipment are that an alternator is low in cost and easy to control e.g. in an alternator by use of both the rotor current field and the load, and thereby the forces applied to the exercising person.

In the following description of another aspect of the present invention, an alternator type device will be used as an example, but it will be understood that this is merely for purposes of explaining the concepts involved, and therefore does not limit the application of these concepts to alternators.

In a conventional alternator the rotor consists of a coil that generates a magnetic field. As the rotor rotates, this field couples to the stator coil in such a way a voltage is generated across the stator coil. In prior art arrangements, the form of the voltage across the stator field is typically a 3 phase AC waveform. Inside the alternator package 6 diodes are used in a conventional full-wave rectification circuit to generate DC from the AC stator voltage. In a vehicle application of an alternator, this DC voltage is used to charge the vehicle battery.

Figure 20:
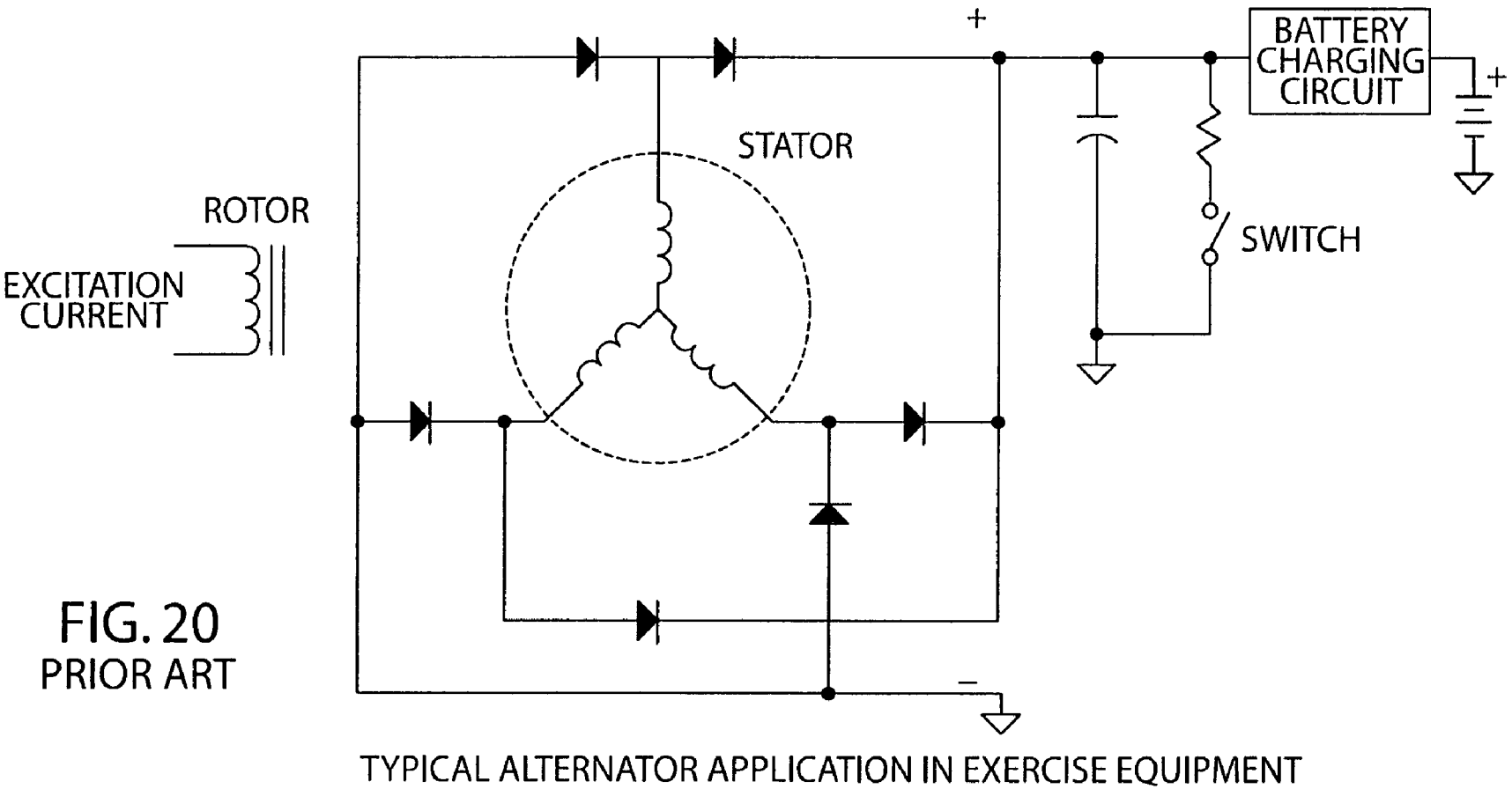
FIG. 20 PRIOR ART
FIG. 20 is a circuit diagram of a prior art alternator control circuit.

When used in an exercise device, the DC voltage generated by the alternator is applied to a switchable load. A typical prior art alternator arrangement for exercise equipment is illustrated in FIG. 20. To change the braking force applied to the exercising person, the load is commonly switched on and off so that the average current passing out of the alternator is controlled. The average current times the average voltage equals the wattage being extracted from the exercising person. Sometimes, in addition to a switchable load, the rotor current is adjusted as well to charge the battery correctly.

In prior art arrangements, a microprocessor is typically used to control the load on the exercising person. The microprocessor changes the current in the rotor and switches the load on the alternator on and off to generate the desired load on the exercising person. Often the microprocessor uses both the switchable load and the rotor excitation current to adjust both the load on the exercising person and also the voltage and current applied to the exercise device's battery to charge it. Thus, the microprocessor has two control variables, rotor excitation current and load value, and also has two goals, obtaining correct exercise load and charging the battery correctly.

Figure 21:
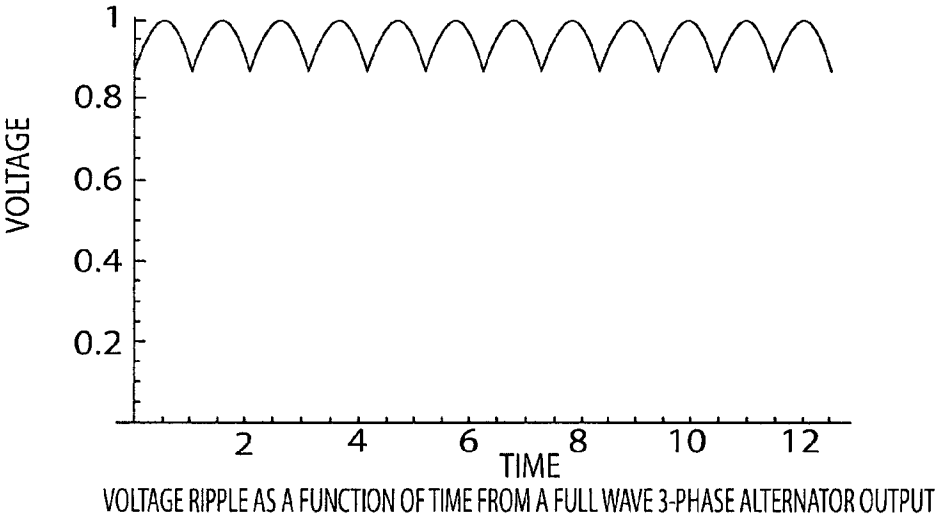
FIG. 21 is a diagram showing power ripple produced by the alternator control circuit of FIG. 20.
Figure 22:
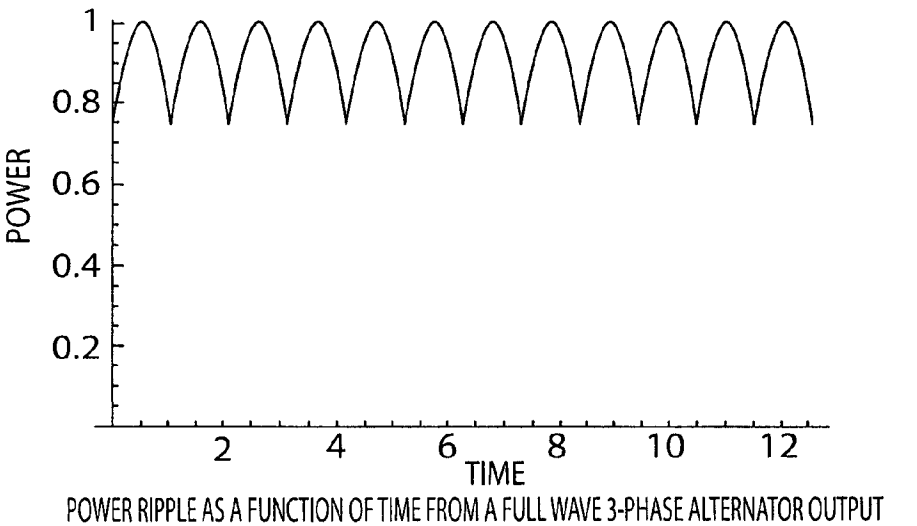
FIG. 22 is a graph showing voltage ripple produced by the alternator control circuit of FIG. 20.

Several disadvantages pertain to the use of an alternator in this way (i.e. use of a bridge and a DC load). First, torque ripple is caused by the ripple in the stator voltage. This torque ripple can be felt by the exercising person as a vibration or "bumpiness" in the resistance force applied to the exercise device. Typically, the torque ripple is about 25% of the torque generated by the alternator. Examples of power and voltage ripple as a function of time are shown in FIGS. 21 and 22. Another disadvantage is that an alternator used with a bridge rectifier does not utilize the alternator in an optimum way as a brake, because only a single pair of windings is generating current at any given time. Thus, the maximum power that can be extracted from the exercising person for a given alternator is less than could be obtained if the alternator's stator winding were loaded in such a way as to use all the stator windings at once. Yet another disadvantage is that a typical load circuit is very slow in responding to control changes in the exercise equipment, because the circuit used for the stator DC voltage commonly has a large capacitor to smooth the control behavior. Another disadvantage is that the rotor current cannot be set arbitrarily to obtain optimum exercise performance, because the stator needs to generate voltage in excess of the battery voltage in order to charge the battery (typically 12 volts). Therefore the rotor generates eddy current losses and other losses in the system that deleteriously affects the exercise device performance particularly at the lower range of resistances provided.

A circuit 155 (FIG. 23) according to one aspect of the present invention alleviates or eliminates these disadvantages. The circuit 155 eliminates all, or substantially all, torque ripple from the alternator. Also, the circuit 155 uses all the alternator windings simultaneously, such that a given alternator can generate 50% more load. Also, the circuit 155 is very fast in response to the control input of the brake (force control) system, and it also allows for arbitrary setting of the rotor current, so very large load dynamic range can be obtained while still charging the battery and avoiding generation of eddy current losses and the like that would otherwise effect exercise device performance.

Figure 23:
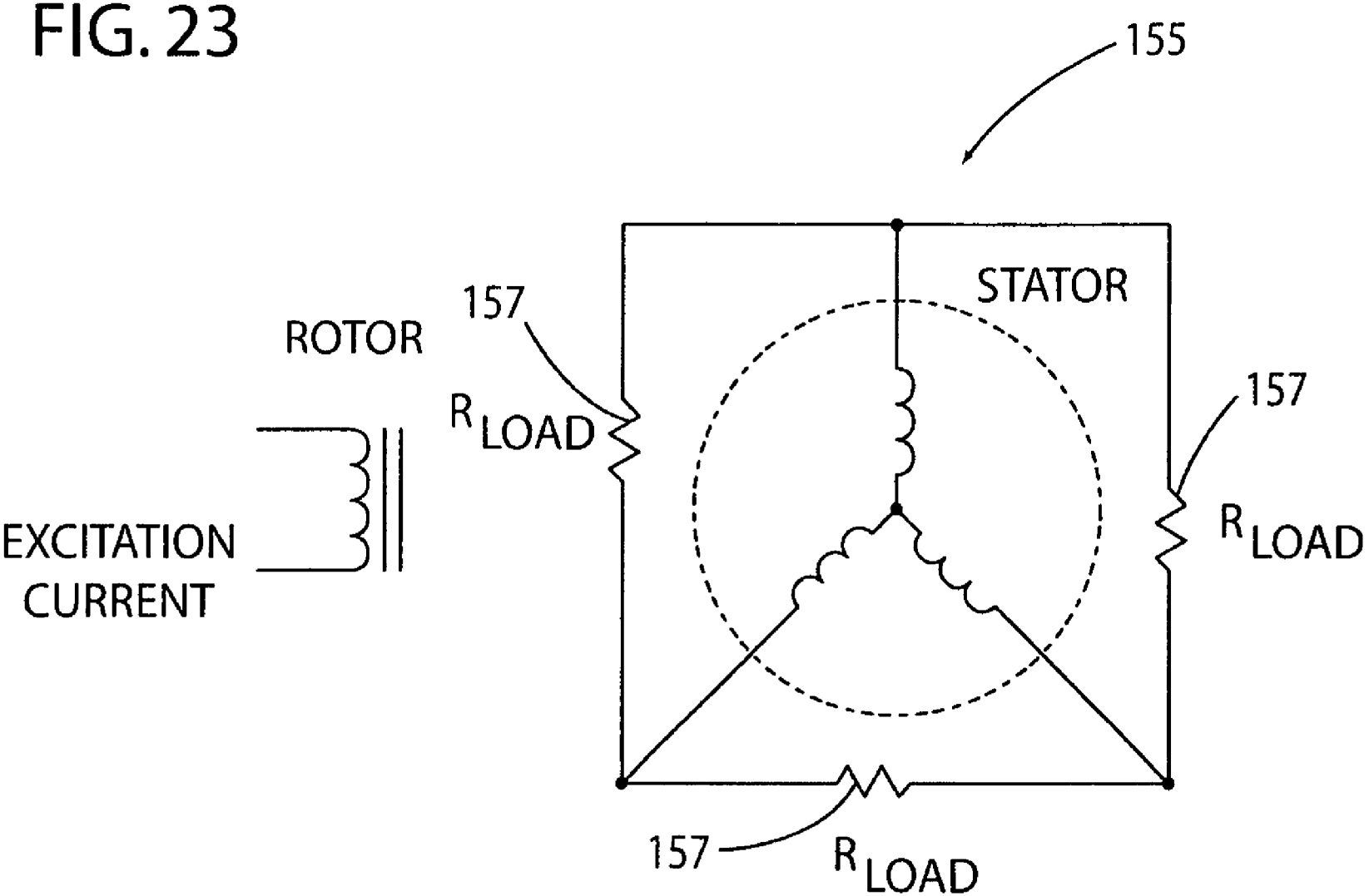
FIG. 23 is a circuit diagram of an alternator control arrangement according to another aspect of the present invention.
Figure 24:
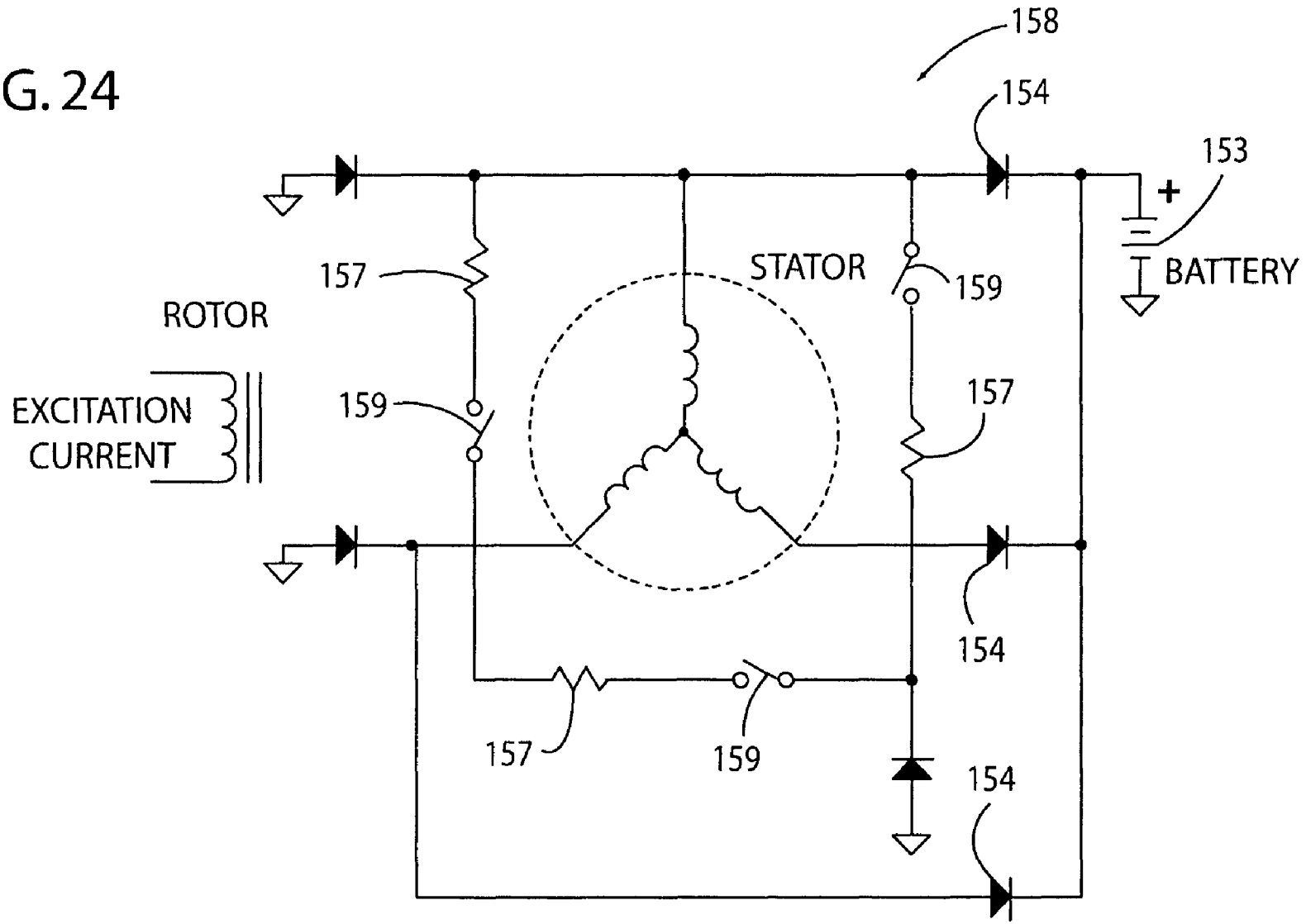
FIG. 24 is a circuit diagram of an alternator control arrangement according to another aspect of the present invention.

With reference to FIGS. 23 and 24, in circuits 155 and 158 according to the present invention the load on the AC voltage generated by the alternator stator. In circuits 155 and 158, the magnitude of the excitation current (also known as "field current") is controlled to thereby vary the resistance force developed by the alternator. In general, if the excitation current is zero, no current will flow through resistors 157 even if the rotor is moving, and the alternator will not generate any resistance force (torque). However, as the excitation current increases, current flows through the resistors and the alternator produces a resistance force felt by the user of the exercise equipment. It will be understood that the resistance torque of the alternator for a given excitation current is generally constant (i.e., the resistance torque does not vary with r.p.m. of the alternator). However, the power taken from the system by the alternator varies with r.p.m. Therefore, if the control system of the exercise equipment is configured to control the power of the alternator as the control variable, the alternator gain or transfer function will be configured to account for the variation of power due to r.p.m. (or other system component).

Significantly, the load configuration of circuits 155 and 158 has no intrinsic torque ripple. The reason for this is as follows. The 3 outputs of the alternator can be thought of as 3 sine wave voltage generators with voltages A sin (ωt), A sin (ωt+⅔Pi), and A sin (ω−⅔Pi). These represent conventional 3 phase waveforms. The instantaneous power out of each winding is then A sin(ωt)^2/Rload, etc., and the sum of these three power terms is 1.5 A^2, so it has no dependency on time at all. Therefore the power output of the alternator has no power ripple, and because of this and the fact that power=force× velocity, it has no torque ripple.

Additionally, circuits 155 and 158 generate current from all the windings at once. In contrast with a conventional circuit which generates approximately A^2/Rload output power for a given stator winding peak voltage A, circuits 155 and 158 obtain 1.5 A^2/Rload power, or 1.5 times the power, without drawing higher than the allowable current from the stator windings. In other words, the load power factor in circuits 155 and 158 is 1, while the load power factor on a conventional circuit is 1/Sqrt[3]. It is well known that a higher power factor results in lower internal heating for a given load in devices such as alternators and motors. Thus, the circuits 155 and 158 are capable of generating 1.5 times the load of a conventional circuit without overheating the alternator. Alternately, a smaller alternator can be used to generate the same load. This increase in power factor facilitates control according to the invention because a control system according to the invention may require high peak power from the same device (rather than a steady, unrealistic power output). This peak power may possibly be close to twice the power required during the use of a conventional alternator load on a conventional exercise bike.

Another advantage of circuits 155 and 158 is that the circuits respond very quickly to control changes. Only the rotor excitation current is used for the load control, and the alternator responds almost instantaneously to the rotor excitation current changes (on the order of less than 1 millisecond, which for exercise equipment applications is essentially instantaneous). Yet another advantage of circuits 155 and 158 is that the rotor excitation can run from 0 volts to full rotor voltage, so the dynamic range of control is very large. Since the power into the load is proportional to the square of the voltage on the stator, and the voltage on the stator is proportional to the excitation current, the power out of the alternator is proportional to the square of the excitation current. So a 100:1 change in rotor current results in a 10,000:1 change in the load power, a very large dynamic range.

The circuit 155 of FIG. 23 does not include a provision for charging a battery. However, as shown in FIG. 24, a circuit 158 according to another aspect of the present invention includes battery charging capabilities. In use, switches 159 are opened briefly at typically 20 kHz (for example 5 microseconds every 50 microseconds), and the voltage generated by the stator jumps to a higher voltage because the stator windings of the alternator act as flyback coils as in a flyback power supply. The stator coils are charged up with the current that flows through resistors 157, and when switches 159 open, the coils have charged up L I^2/2 energy. Each time switches 159 are opened some of this energy is discharged into the battery 153. The period of the open switches is so short that the current through the stator coils do not change very much. Also, the process occurs so quickly that there is no significant torque effect on the exercising person. The voltage jumps up until the diodes 154 forward conduct current into the battery, thereby charging battery 153 in spite of the fact that the voltage across the resistor loads on the stator average much less than the battery voltage. Because of the flyback effect, the battery charging can be accomplished without generating battery-level voltages on the stator windings. Because of this, the battery charging process does not force the rotor excitation to be great enough to generate the battery voltage on the stator. When operated at low excitation and low power, circuit 158 does not generate the eddy current and other losses that the conventional circuit generates at low output power. Circuit 158 also has only the current used to charge the battery passing through the diodes 154, and so the diodes 154 are much smaller, use much less power, and are much less expensive than typically used in prior control schemes and circuits.

A further advantage of allowing the rotor current to go to low values during the power control process is that alternators have losses caused by the magnetic fields generated by the rotor excitation current. By controlling the rotor excitation, and allowing it to go to zero when the user is applying little or no force to the equipment, the baseline forces of the system are minimized.

A microprocessor in the exercise equipment controls the period the switches 159 are off to control the flow of current into battery 153. Using the switch off period as a control, the battery charging can be easily controlled over a wide range of currents. The charging of the battery 153 is essentially independent of the stator voltage, so the microprocessor control system can charge the battery as required by the battery's current state of charge and other factors, without requiring the load presented to the exercising person to be unduly affected. The control system can take into account the power generated by the alternator that goes into the resistor loads, and also the power that goes into the battery, so that any exercise load power desired can be generated.

The alternator output used to charge battery 153 also can be used to operate the other circuits in the exercise equipment, such as displays, computers, controls, and the like. The power required to operate the exercise equipment is also accounted for in the exercise load calculation, so the exercising person feels the desired load independent of the operation of the charging or operating circuits.

Figure 25:
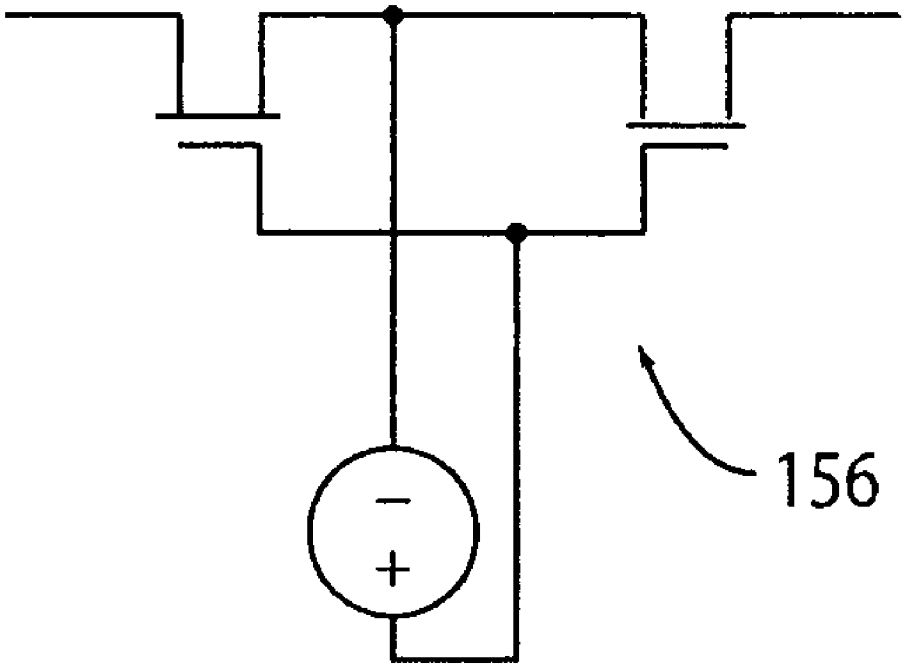
FIG. 25 is a circuit diagram of a bipolar current switch that can be utilized in an alternator control system according to another aspect of the present invention.

Switches 159 comprise bipolar high-current switches as shown in FIG. 25. Switches 159 are connected in series with stator load resistors 157. Although various switch configurations could be utilized a typical design for switches 156 is shown in FIG. 25.

Although the control system of the present invention may take various forms, it will be understood that the rider power estimation versions of FIGS. 1A, 1B and 2 and the force measurement systems of FIGS. 3-5 utilize a difference between a measured value related to a user's effect on the exercise equipment, and a virtual value that is determined, at least in part, upon the physics governing the actual physical activity being simulated.

The power estimation control systems described above utilizes the power generated by the rider to calculate the force input by the rider utilizing the relationship between force and power (power equals force times velocity). This calculated force is, in turn, used to calculate the virtual acceleration utilizing the principle that force is equal to mass times acceleration. The acceleration is then integrated to provide the virtual velocity. The difference between the virtual velocity and the measured velocity is then used as the control input to the alternator or other force-generating device to increase the resistance force as the difference between the virtual velocity and the measured velocity increases.

The force-measurement versions of the control system also utilize the difference between the measured velocity and the virtual velocity. However, the force-measurement versions of the system use the measured user force rather than the user force calculated from power as described above.

In general, the control system may be configured to push the difference between the measured velocity and the virtual velocity to zero, or to a small difference.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. An exercise device for simulating a human physical activity of the type involving an application of a human input force to an object resulting in acceleration of the object in a manner that is capable of being described by an equation of motion of the type that describes the acceleration of a mass under an influence of a force generated by a human in performing the activity, the exercise device comprising:

a structural support;

a user input member movably connected to the structural support for movement relative to the structural support to define a measured velocity that is measured during application of an input force to the input member by a user, and wherein the user input member defines a variable resistance force tending to resist movement due to input force applied by a user;

a control system that utilizes a velocity difference between the measured velocity and a virtual velocity as a control input to control the resistance force on the user input member, wherein the control system is configured to continuously and rapidly recalculate the virtual velocity while an input force is being applied to the input member by a user, and wherein the control system is configured to determine the virtual velocity, at least in part, utilizing an equation of motion of the type that describes the acceleration of a mass under an influence of a force for the human physical activity being simulated and wherein the control system is configured to continuously and rapidly recalculate the velocity difference while an input force is being applied to the input member by a user such that the resistance force varies to simulate the changes in force experienced by a user due to changes in momentum of the human physical activity that is being simulated.

2. The exercise device of claim 1, wherein:

the control system includes a sensor that measures a variable associated with movement and the user input member from which a velocity of the user input member can be determined.

3. The exercise device of claim 2, wherein:

the control system includes a force-generating device that supplies the variable resistance force.

4. The exercise device of claim 3, wherein:

the force-generating device comprises an alternator.

5. The exercise device of claim 4, wherein:

the alternator is controlled in such a way that the alternator is substantially free of torque ripple.

6. The exercise device of claim 3, wherein:

the control system includes a controller connected to the sensor and the force-generating device and sending a signal to the force-generating device based, at least in part, on a signal from the sensor.

7. The exercise device of claim 6, wherein:

the controller determines an estimated user power, and utilizes the estimated user power to determine the measured velocity.

8. The exercise device of claim 6, wherein:

the controller updates the virtual velocity in a manner that takes into account the effects of momentum.

9. The exercise device of claim 8, wherein:

the controller utilizes a linear relationship between acceleration and force to determine the effects of momentum.

10. The exercise device of claim 8, wherein:

the controller updates the virtual velocity by summing the effects of aerodynamic drag and momentum.

11. The exercise device of claim 10, wherein:

the controller updates the virtual velocity by taking into account a slope of a virtual hill.

12. The exercise device of claim 11, wherein:

the controller updates the virtual velocity by taking into account the effects of friction losses.

13. The exercise device of claim 11, wherein:

the exercise device comprises a stationary bike, and the user input member comprises a crank having a pair of pedals that move in a generally circular path about an axis.

14. The exercise device of claim 13, wherein:

the controller includes a mathematical model of a bike that takes into account the physics associated with riding a moving bike, and wherein the mathematical model is utilized to calculate the virtual velocity.

15. The exercise device of claim 14, wherein:

the mathematical model includes a plurality of gear ratios, and wherein the controller includes a user input feature that enables a user to select and change gears.

16. The exercise device of claim 14, wherein:

the controller includes a user input feature that permits a user to select a weight used in the mathematical model.

17. The exercise device of claim 1, wherein:

the control system utilizes a measured force to determine the virtual velocity.

18. The exercise device of claim 1, wherein:

the control system is configured to vary the resistance force in a manner that tends to minimize the velocity difference.

19. The exercise device of claim 1, wherein:

the control system is configured to vary the resistance force in a manner that drives the velocity difference to a predetermined value.

20. A stationary exercise bike, comprising:

a support structure;

a crank including a pair of pedals rotatably mounted to the support structure;

a force-generating device operably connected to the crank and providing a variable resistance force tending to resist a force applied to the pedals by a user;

a sensor configured to measure a variable associated with the crank during operation from which an actual velocity can be determined;

an electrical control unit connected to the sensor and the force-generating device, wherein the electrical control unit includes an internal bike model including at least one term describing acceleration of a mass under an influence of a force, wherein the internal bike model is utilized to determine a virtual velocity and a virtual acceleration of the internal bike model, and wherein the internal bike model utilizes the measured variable as an input to the internal bike model, and wherein the internal bike model determines an updated virtual velocity from a prior virtual velocity stored in the electrical control unit by determining a rider force by summing at least the effects of the measured variable, an aerodynamic loss determined utilizing the prior virtual velocity, and an effect due to a hill angle determined according to a weight and a slope of a virtual hill, and wherein the virtual acceleration is integrated to provide the virtual velocity, and wherein:

the controller utilizes a velocity difference between the actual velocity and the virtual velocity as a control input, and increases the variable resistance force of the force-generating device in a manner that tends to reduce the velocity difference.

21. The stationary bike of claim 20, wherein:

the sensor comprises a force sensor, and the measured variable comprises a rider force.

22. The stationary bike of claim 21, wherein:

the rider force is modified prior to input to the internal bike model by dividing the rider force by a gear rollout.

23. The stationary bike of claim 22, wherein:

the stationary bike includes a gear selection feature enabling a user to select the gear rollout.

24. The stationary bike of claim 20, wherein:

the measured variable is related to a power input to the stationary bike by a user; and wherein:

the controller determines the power input by a user and determines an estimated rider force by dividing the power input by a user by a prior virtual velocity, and wherein the estimated rider force is utilized as the measured variable that is input to the internal bike model.

25. The stationary bike of claim 20, wherein:

the force-generating device comprises an alternator.

26. The stationary bike of claim 25, wherein:

the alternator is connected to the crank by an elongated flexible member having the form of a loop.

27. A stationary exercise bike for simulating a mobile bike that includes a pair of wheels configured to rotatably support the mobile bike on a surface, the motion of which is capable of being described by an equation of motion of the type that describes the acceleration of a mass under an influence of a force, the stationary exercise bike comprising:

a structural support;

a pair of pedals movably connected to the structural support for generally circular movement relative to the structural support to define an actual velocity upon application of a force to the pedals by a user, and wherein the pedals define a variable resistance force tending to resist movement duebto force applied by a user;

a control system that calculates a virtual velocity utilizing either a measured value of a force applied to the pedals by a user, or a variable that is a function of a force applied to the pedals by a user, the control system further utilizing an equation of motion of the type that describes the acceleration of a mass under an influence of a force describing the motion of a mobile bike, the control system utilizing a velocity difference between the actual velocity and a virtual velocity as a control input to control the resistance force of the pedals.

28. An exercise device for simulating a human physical activity of the type involving an application of a human input force to an object resulting in acceleration of the object in a manner that is capable of being described by an equation of motion of the type that describes the acceleration of a mass under an influence of a force generated by a human in performing the activity, the exercise device comprising:

a structural support;

a user input member movably connected to the structural support for movement relative to the structural support to define a measured variable upon application of an input force to the input member by a user, and wherein the user input member defines a variable resistance force tending to resist movement due to input force applied by a user;

a control system configured to utilize first and second values of the measured variable that are both measured while a user is applying an input force to the input member, and wherein the first value is measured before the second value, and wherein the control system is configured to determine a difference between the first value of the measured variable, and a first value of a virtual variable as a control input to control the resistance force on the user input member, wherein the control system is configured to determine the virtual variable, at least in part, utilizing an equation of motion of the type that describes the acceleration of a mass under an influence of a force input by a human for the human physical activity being simulated, and wherein the control system is configured to utilize the first value of the measured variable as an input variable in the equation of motion such that the resistance force varies in a manner that simulates changes in force due to changes in momentum according to the equation of motion.

* * * * *